US009799442B1

(12) United States Patent
Folker et al.

(10) Patent No.: US 9,799,442 B1
(45) Date of Patent: Oct. 24, 2017

(54) MAGNETIC CORE STRUCTURES FOR MAGNETIC ASSEMBLIES

(71) Applicant: Universal Lighting Technologies, Inc., Madison, AL (US)

(72) Inventors: Donald Folker, Madison, AL (US); Mike LeBlanc, Huntsville, AL (US); James Neal Van Pelt, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/827,425

(22) Filed: Aug. 17, 2015

Related U.S. Application Data

(60) Provisional application No. 62/038,679, filed on Aug. 18, 2014, provisional application No. 62/047,796, filed on Sep. 9, 2014.

(51) Int. Cl.
*H01F 27/32* (2006.01)
*H01F 41/02* (2006.01)

(52) U.S. Cl.
CPC ..... *H01F 27/325* (2013.01); *H01F 41/0206* (2013.01)

(58) Field of Classification Search
CPC ..... H01F 27/325; H01F 27/255; H01F 27/26; H01F 27/263; H01F 27/266
USPC ..... 336/198, 208, 199, 196
See application file for complete search history.

(56) References Cited

U.S. PATENT DOCUMENTS 5,696,477 A * 12/1997 Yamamori ..... H01F 27/027 336/185
6,144,278 A * 11/2000 Nishida ..... H01F 27/266 336/198
6,162,067 A * 12/2000 Haga ..... H01F 5/02 336/192
6,208,232 B1 * 3/2001 Chen ..... H01F 27/292 336/107
7,515,026 B1 * 4/2009 Liu ..... H01F 27/326 336/198
7,717,631 B2 * 5/2010 Suzuki ..... H01F 5/02 336/208
2003/0080844 A1 * 5/2003 Nishikawa ..... H01F 27/306 336/178
2004/0036568 A1 * 2/2004 Suzuki ..... H01F 27/325 336/192

(Continued)

*Primary Examiner* — Elvin G Enad
*Assistant Examiner* — Malcolm Barnes
(74) *Attorney, Agent, or Firm* — Patterson Intellectual Property Law, P.C.; Mark J. Patterson; Gary L. Montle

(57) ABSTRACT

A magnetic assembly includes a bobbin with two end flanges. A passageway extends longitudinally between the end flanges. An inner core extends through, and is centered in, the passageway. The inner core has first and second end surfaces, each surface proximate to one of the end flanges. A rectangular outer core is positioned around the bobbin with inner surfaces of the outer core close to the outer surfaces of the end flanges of the bobbin. A respective gap is formed between each end of the inner core and the adjacent inner surface of the outer core. The passageway includes crushable ribs that secure the inner core within the passageway. The outer surfaces of the end flanges include crushable ribs that secure the core with respect to the bobbin. The passageway and inner core may have an oval-shaped profile. The passageway and inner core may have a circular profile.

17 Claims, 16 Drawing Sheets

(56) References Cited

U.S. PATENT DOCUMENTS

| | | | | |
|---|---|---|---|---|
| 2004/0075524 | A1* | 4/2004 | Nagai | H01F 27/325 336/208 |
| 2004/0119575 | A1* | 6/2004 | Steiner | H01F 27/292 336/208 |
| 2005/0275498 | A1* | 12/2005 | Haga | H01F 5/02 336/208 |
| 2007/0273466 | A1* | 11/2007 | Yang | H01F 27/325 336/220 |
| 2011/0080243 | A1* | 4/2011 | Lo | H01F 27/263 336/90 |
| 2012/0223641 | A1* | 9/2012 | Chiang | H01F 27/325 336/212 |
| 2014/0176291 | A1* | 6/2014 | Zheng | H01F 27/325 336/233 |
| 2015/0380150 | A1* | 12/2015 | Sommer | H01F 27/263 336/192 |

* cited by examiner

MAGNETIC CORE STRUCTURES FOR MAGNETIC ASSEMBLIES

CROSS-REFERENCES TO RELATED APPLICATIONS

This application claims benefit of the following patent applications which are hereby incorporated by reference: U.S. Provisional Patent Application No. 62/038,679 filed Aug. 18, 2014, entitled "Magnetic Assembly with Round Center Leg Core;" and U.S. Provisional Patent Application No. 62/047,796 filed Sep. 9, 2014, entitled "Magnetic Core Structure for Tall and Low Profile Magnetic Assemblies."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Currently, magnetic assemblies are made with two "E" shaped cores, with the center leg of each core inserted into a bobbin from respective ends of the bobbin. The exposed end of the center leg of each "E" core is ground to reduce the length of the center leg with respect to the outer legs of the core. Thus, when the mating ends of the outer legs of the two cores meet outside the bobbin, the mating ends of the center legs are offset by a small amount to create a gap between the cores approximately at the center of the bobbin. This center leg gap is located directly below the center of the winding. The stray magnetic field from the gap creates loss in the winding. Because the core assembly is made from two "E" shaped cores, the two cores must be glued or taped together after installation in the bobbin to keep the ends of the outer legs fully engaged and thereby maintain a fixed dimension for the gap between center legs.

BRIEF SUMMARY OF THE INVENTION

An aspect of the invention disclosed herein is a magnetic assembly that does not require the grinding of the center legs of two "E" cores to create a center gap. In accordance with this aspect, the magnetic assembly includes a bobbin having a first outer flange and a second outer flange. A passageway extends through the bobbin from the first outer flange to the second outer flange. At least one winding is wound about the passageway. The bobbin also has at least one crushable passageway rib protruding into the passageway, and has at least one crushable flange rib on each outer flange.

The magnetic assembly further includes a magnetic core having an inner core and an outer core. The inner core is positioned through the passageway of the bobbin. The inner core has a first end surface proximate to the first outer flange and a second end surface proximate the second outer flange. The inner core is positioned in frictional engagement with the crushable passageway rib. The outer core has a first inner surface and a second inner surface. The outer core is positioned around the bobbin with the first inner surface in frictional engagement with the at least one crushable flange rib on the first outer flange. The first inner surface is spaced apart from the first end surface of the inner core by a first gap distance. The second inner surface is in frictional engagement with the at least one crushable flange rib on the second outer flange. The second inner surface is spaced apart from the second end surface of the inner core by a second gap distance. In certain embodiments, the first gap distance is substantially equal to the second gap distance.

In certain embodiments, the at least one passageway rib includes a first passageway rib on a first inner surface of the passageway and a second passageway rib on a second inner surface of the passageway, with the second passageway rib positioned across from the first passageway rib. In certain embodiments, the at least one passageway rib is tapered from a first protrusion height proximate to the first outer flange to a smaller second protrusion height in a direction toward the second outer flange. The inner core is inserted into the passageway from the second outer flange and is forced through the passageway toward the first outer flange, thereby crushing the at least one passageway rib into frictional engagement with the inner core.

In certain embodiments, the at least one flange rib on each of the first and second outer flanges may include a first flange rib on a first side of the passageway and a second flange rib on a second side of the passageway. Each flange rib is tapered from a first thickness at one end of the flange rib to a second smaller thickness at a second end of the flange rib.

In certain embodiments, the outer core is installed on the bobbin by positioning the outer core over the respective first ends of the flange ribs and forcing the outer core toward the respective second ends of the flange ribs. The inner surfaces of the outer core crush the flange ribs and cause the flange ribs to frictionally engage the respective inner surfaces of the outer core.

In certain embodiments, the outer core is rectangular. In certain embodiments, the passageway has a profile selected to have at least two arcuate sides, and the inner core has a profile selected such that the inner core fits snugly within the passageway. For example, in some embodiments, the passageway profile and the inner core profile are oval with two arcuate sides at opposing ends of the oval and with first and second straight sides connecting the two arcuate sides. The first and second straight sides may be vertical. The first and second straight sides may also be horizontal such that the magnetic assembly is a low profile magnetic assembly.

Another aspect in accordance with embodiments disclosed herein is a magnetic assembly that includes a bobbin, an inner core and an outer core. The bobbin has a first end flange with a first outer flange surface and a second end flange with a second outer flange surface. A passageway extends from the first end flange to the second end flange and has a passageway length. At least one winding is wound about the passageway between the first end flange and the second end flange. The inner core is positioned in the passageway. The inner core has a first end surface and second end surface. The inner core has an inner core length between the first end surface and the second end surface wherein the inner core length is substantially equal to the passageway length. The inner core is positioned in the passageway with the first end surface proximate to the first end flange and with the second end surface proximate to the second end flange. The outer core is positioned around the bobbin. The outer core has a first inner surface and a second inner surface. The second inner surface is parallel to the first inner surface. The first inner surface and the second surface are spaced apart by an outer core inner surface spacing selected to be greater than the inner core length. The outer core is positioned with respect to the inner core such that the first inner surface of the outer core is spaced apart from the first end surface of the inner core by a first gap distance and the second inner surface of the outer core is spaced apart from the second end surface of the inner core by a second gap distance.

In certain embodiments, the first gap distance and the second gap distance are substantially equal. In certain embodiments, the passageway has at least one passageway rib. The at least one passageway rib may be a crushable material and is tapered to protrude into the passageway by a first protrusion distance proximate the first end flange and to protrude into the passageway by a second protrusion distance at a position closer to the second end flange. The at least one passageway rib is crushed by the insertion of the inner core into the passageway to cause the passageway rib to frictionally engage the inner core and secure the inner core in the passageway.

In certain embodiments, the at least one passageway rib includes two ribs spaced across from each other with respect to the passageway. In certain embodiments, the first outer flange surface of the first end flange and the second outer flange surface of the second end flange each includes a respective first flange rib on a first side of the passageway and a respective second flange rib on a second side of the opening to the passageway. Each flange rib may be formed from a crushable material. Each flange rib is tapered from a first thickness at a first end of the flange rib to a second smaller thickness at a second end of the flange rib.

In certain embodiments, the outer core is positioned on the flange ribs with the first inner surface of the outer core proximate to the first and second flange ribs of the first flange and with the second inner surface of the outer core proximate the first and second flange ribs of the second flange. The first and second inner surfaces of the outer core crush the flange ribs to cause the flange ribs to apply friction to the first and second inner surfaces of the outer core to secure the outer core onto the bobbin. In certain embodiments, the outer core is rectangular parallelepiped.

Another aspect in accordance with embodiments disclosed herein is a method of assembling a magnetic assembly. The method includes positioning an inner core into a passageway of a bobbin having at least one winding wound thereon between a first end flange and second end flange. The inner core has a length selected such that a first end surface of the inner core is proximate to the first end flange and a second end surface of the inner core is proximate to the second end flange. The method further includes positioning an outer core over the first and second end flanges with a first inner surface of the outer core spaced apart from the first end surface of the inner core by a first gap distance and with a second inner surface of the outer core spaced apart from the second end surface of the inner core by a second gap distance. In certain embodiments, the first gap distance and the second gap distance are substantially equal.

In certain embodiments, the passageway includes at least one passageway rib. The at least one passageway rib may be formed from a crushable material and tapered to protrude into the passageway by a first protrusion distance proximate the first outer flange and to protrude into the passageway by a second protrusion distance at a position closer to the second outer flange. The method further includes inserting the inner core into the passageway from the second end flange and pressing the inner core through the passageway until the first end face of the inner core is proximate to the first end flange. The at least one passageway rib is crushed by the insertion of the inner core to frictionally engage the inner core and secure the inner core in the passageway. In certain embodiments, the at least one passageway rib has a first passageway rib on a first inner surface of the passageway and a second passageway rib on a second inner surface of the passageway, wherein the second inner surface of the passageway is opposite the first inner surface of the passageway. In certain embodiments, an outer surface of the first end flange and an outer surface of the second flange each have at least one respective flange rib. Each flange rib may be formed from a crushable material and tapered from a first thickness at a first end of the flange rib to a second smaller thickness at a second end of the flange rib.

The method further includes positioning the first inner surface of the outer core proximate to the at least one flange rib on the outer surface of the first end flange and positioning the second inner surface of the outer core proximate to the second end of the at least one flange rib on the outer surface of the second end flange; and applying force to the outer core to force the outer core over the respective flange ribs on the first and second end flanges to crush the ribs. The crushed ribs apply friction to the first and second inner surfaces of the outer core to secure the outer core to the bobbin. In certain embodiments, the at least one flange rib on each of the first and second end flanges have a respective first flange rib on a first side of the passageway and a respective second flange rib on a second side of the passageway.

The sizes of the gaps are determined by the difference between the length of the inner core and the longitudinal distance between the first and second inner surfaces of the outer core. Accordingly, the sizes of the gaps can be adjusted by selecting the length of the inner core with respect to the distance between the first and second inner surfaces of the outer core.

The resulting magnetic assembly is efficient and easy to manufacture as either a "tall" magnetic assembly or a "low profile" magnetic assembly. The arcuate end surfaces of the inner core and the corresponding arcuate end walls of the passageway through the bobbin allows the windings on the bobbin to be shorter than the windings around a corresponding rectangular passageway, thus reducing the mean length of the wire in each turn and thereby reducing the overall weight of the copper used in the winding.

By replacing the "E" shaped cores with a single inner core and a rectangular outer core, the overall core assembly is easier to manufacture and assemble. In particular, using the rectangular outer core instead of two "E" shaped cores eliminates the need for tape or glue or both to secure the cores after assembly. Accordingly, the overall outer dimensions of the assembly are reduced.

The magnetic assembly described herein may provide a further advantage of having two gaps proximate to the outer surfaces of the end flanges of the bobbin rather than a single gap in the middle of the bobbin. Having two gaps instead of one reduces the stray field produced by the gap in half. Having the two gaps at the ends of the bobbin instead of one gap in the center of the bobbin may reduce or eliminate the interference of the stray magnetic field with the winding, which reduces unwanted loss in the winding.

DETAILED DESCRIPTION OF THE INVENTION

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Figure 1:
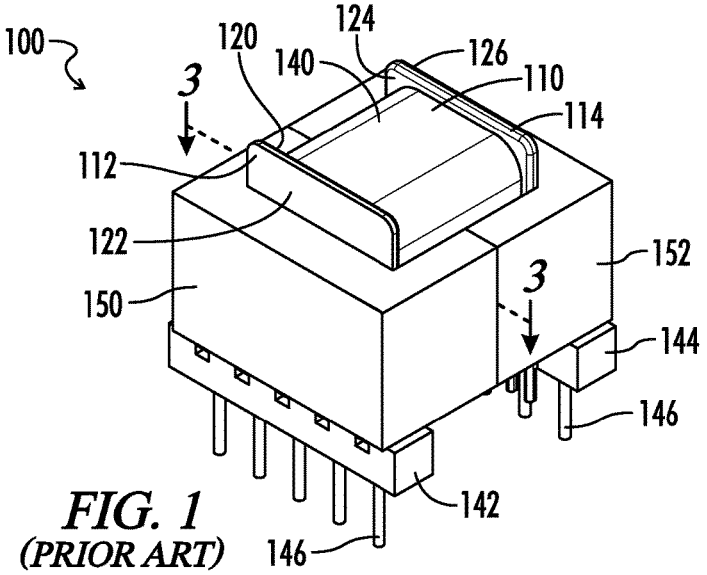
FIG. 1 (PRIOR ART)
FIG. 1 illustrates a perspective view of a conventional "tall" magnetic assembly.
Figure 2:
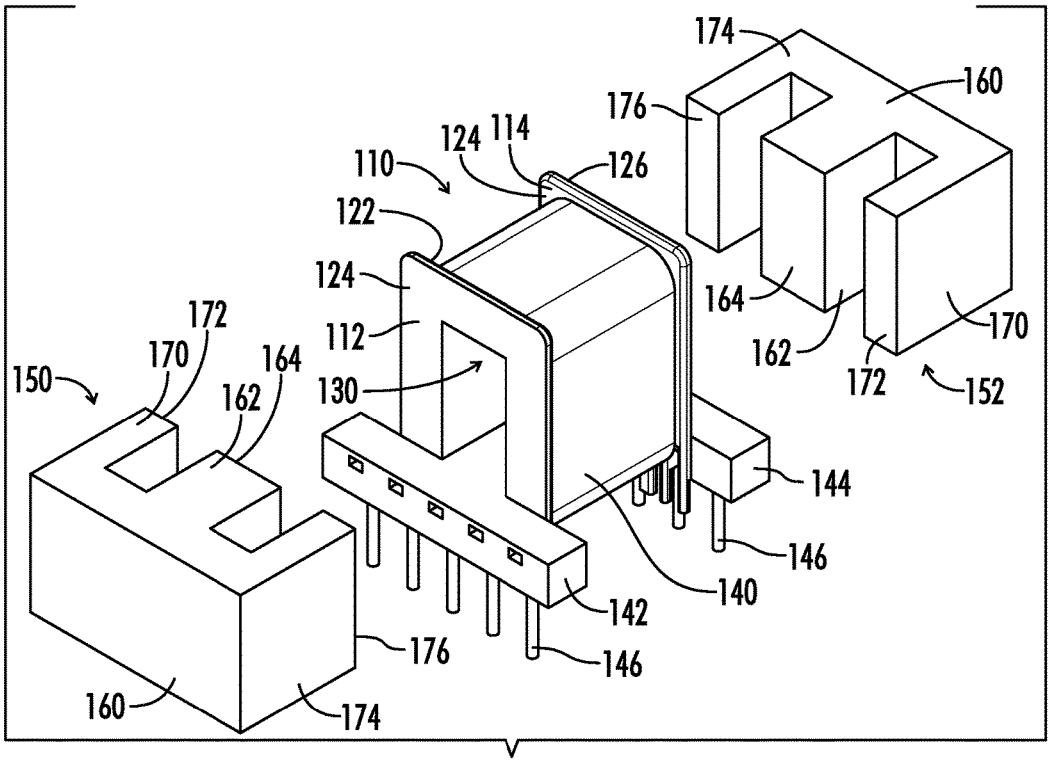
FIG. 2 (PRIOR ART)
FIG. 2 illustrates an exploded perspective view of the assembly of FIG. 1.
Figure 3:
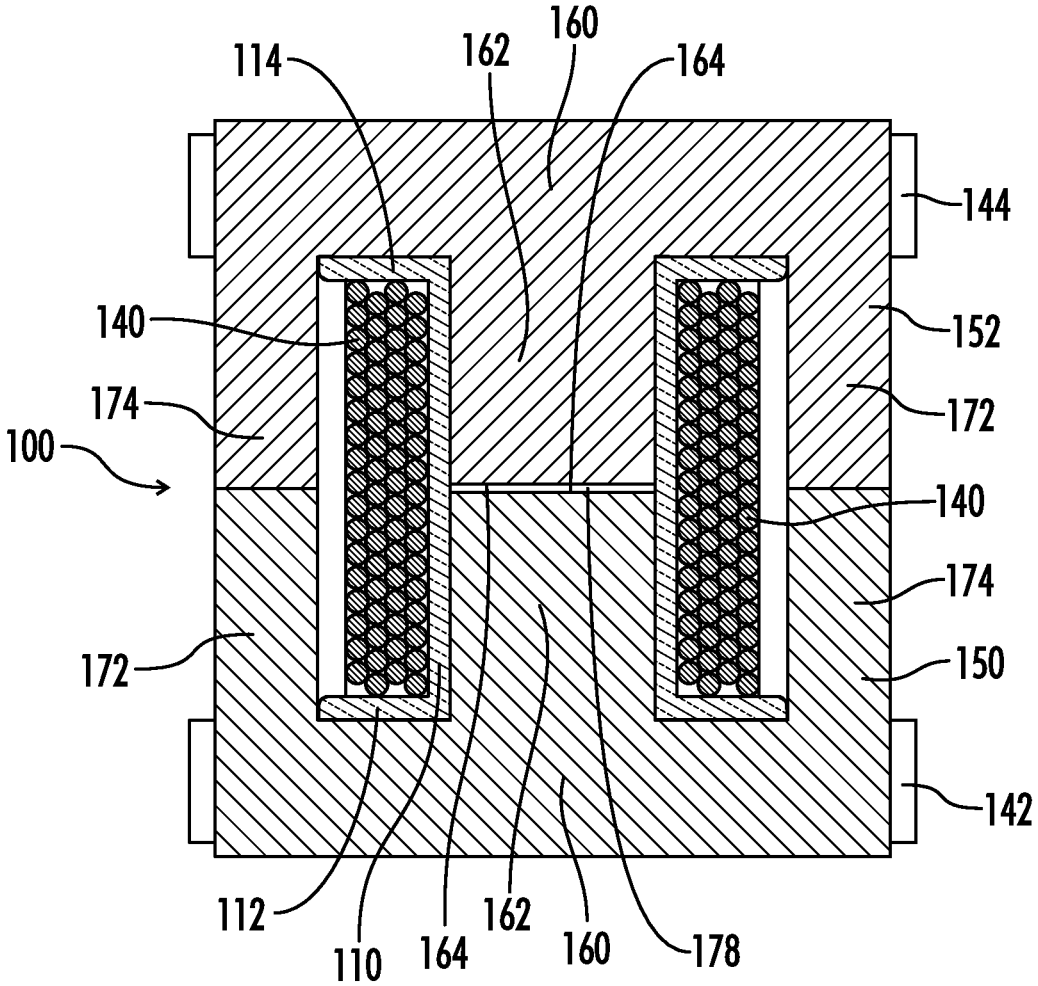
FIG. 3 (PRIOR ART)
FIG. 3 illustrates a cross-sectional upper plan view of the assembly of FIG. 1 taken along line 3-3 in FIG. 1.

FIG. 1 illustrates a perspective view of a conventional "tall" magnetic assembly 100. FIG. 2 illustrates an exploded perspective view of the assembly of FIG. 1. FIG. 3 illustrates a cross-sectional upper plan view of the assembly of FIG. 1 taken along the lines 3-3 in FIG. 1.

The magnetic assembly 100 includes a bobbin 110, which has a first end flange 112 and a second end flange 114. The first end flange 112 has an inner surface 120 and an outer surface 122. The second end flange 114 has an inner surface 124 and an outer surface 126. A longitudinal passageway 130 extends from the outer surface 122 of the first end flange 112 to the outer surface 126 of the second end flange 114. The passageway 130 has a cross-sectional profile. In the illustrated assembly, the profile is generally rectangular. The bobbin 110 further includes a winding 140 having a plurality of turns of an electrically conductive wire (e.g., copper wire) wound around the passageway between the inner surfaces of the end flanges in a conventional manner. Only the outer surface of the winding 140 is shown in FIGS. 1 and 2. The outer surface of the winding 140 is often covered with tape or another coating to protect the outer layer of the winding and thus the turns of the winding are not shown. The first end flange 112 is supported by a first base platform 142. The second end flange 114 is supported by a second base platform 144. The base platforms include a plurality of contact pins 146 that are useable to mount the magnetic assembly to a circuit board (not shown). Some or all of the contact pins 146 are electrically connected to the winding 140 to provide electrical communication from the winding 140 to a circuit board.

As shown in FIG. 2, the magnetic assembly 100 further includes a first E-core 150 formed from a ferromagnetic material, such as, for example, silicon steel, a ferrite material, or other suitable material, and a second E-core 152 of similar construction. Each E-core has a base portion 160 with a center leg 162 extending perpendicularly from the middle of the base portion 160. The center leg 162 has a mating face 164. A first outer leg 170 extends from a first end of the base portion 160 parallel to the center leg 162. The first outer leg 170 has a mating face 172. A second outer leg 174 extends from a second end of the base portion 160 parallel to the center leg 162 and the first outer leg 170. The second outer leg 174 has a mating face 176 When the respective center legs of the two E-cores are installed in the passageway 130 from opposite ends of the bobbin 110, the respective mating faces of the outer legs engage as illustrated in FIG. 1 to provide a continuous magnetic circuit around the outer legs and the base portions. The respective center legs of the two E-cores are shorter longitudinally (e.g., in the distance away from the base portions) than the respective outer legs. The center legs may be made shorter longitudinally than the outer legs by grinding or other conventional techniques. Because of the relative longitudinal shortness of the center legs, when the mating faces of the two outer legs engage, the mating faces of the center legs are spaced apart by a selected distance to form a gap 178 (FIG. 3) in the magnetic path through the center legs. In the illustrated conventional magnetic assembly, the gap 178 is positioned substantially in the middle of the longitudinal passageway and is thus directly beneath the middle of the winding 140. As discussed above, the positioning of the gap in the middle of the passageway allows stray magnetic fields to interfere with the winding and cause unwanted loss in the winding.

The magnetic assembly 100 of FIGS. 1, 2 and 3 is referred to herein as a "tall" magnetic assembly. As shown in FIG. 2, the heights of the center legs 164 of the E-cores 150, 152 are substantially equal to the heights of the base portions 160 and the heights of the first outer legs 170 and the second outer legs 174. The passageway 130 of the bobbin 110 has a width and a height that are sized to accommodate the widths and heights of the center legs. In addition, the winding 140 has a thickness that adds to the height of the passageway. In most embodiments, the end flanges 112, 114 are sized to extend a short distance beyond the outer boundary of the winding. Thus, when the magnetic assembly is assembled as shown in FIG. 1 with the center legs in the passageway 130 of the bobbin, the end flanges of the bobbin extend above and below the E-cores. Thus, overall height of the magnetic assembly is "tall" with respect to the heights of the outer legs of the E-cores.

Figure 4:
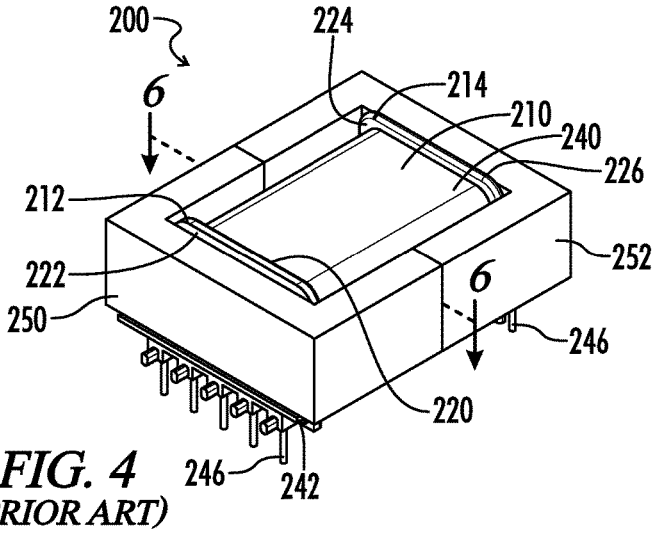
FIG. 4 (PRIOR ART)
FIG. 4 illustrates a perspective view of a conventional "low profile" magnetic assembly.
Figure 5:
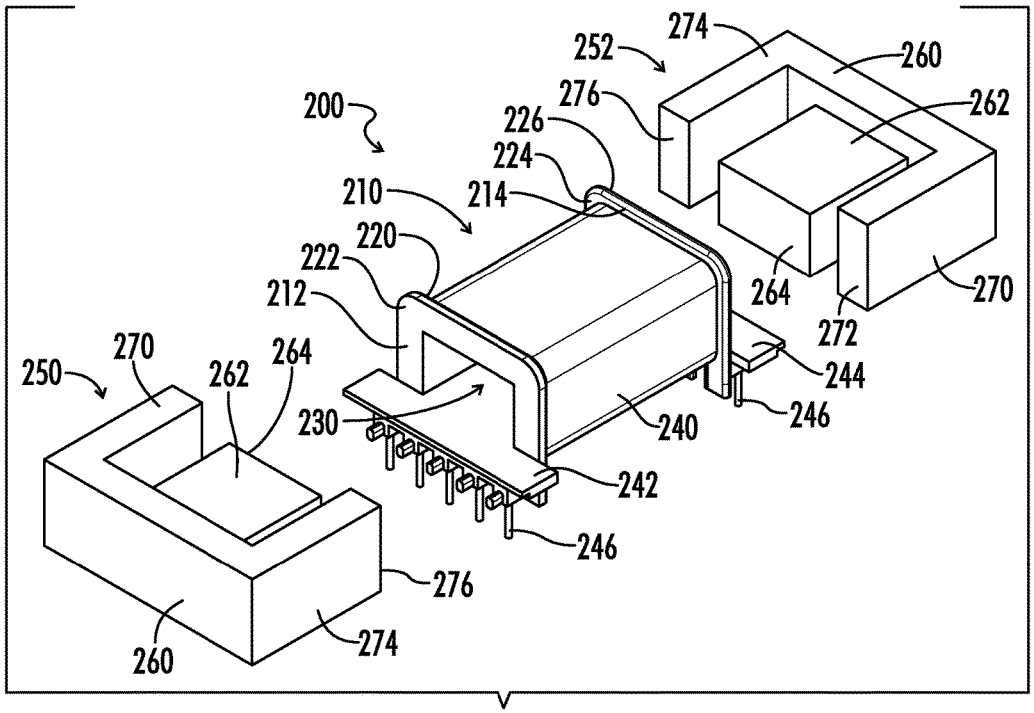
FIG. 5 (PRIOR ART)
FIG. 5 illustrates an exploded perspective view of the assembly of FIG. 4.
Figure 6:
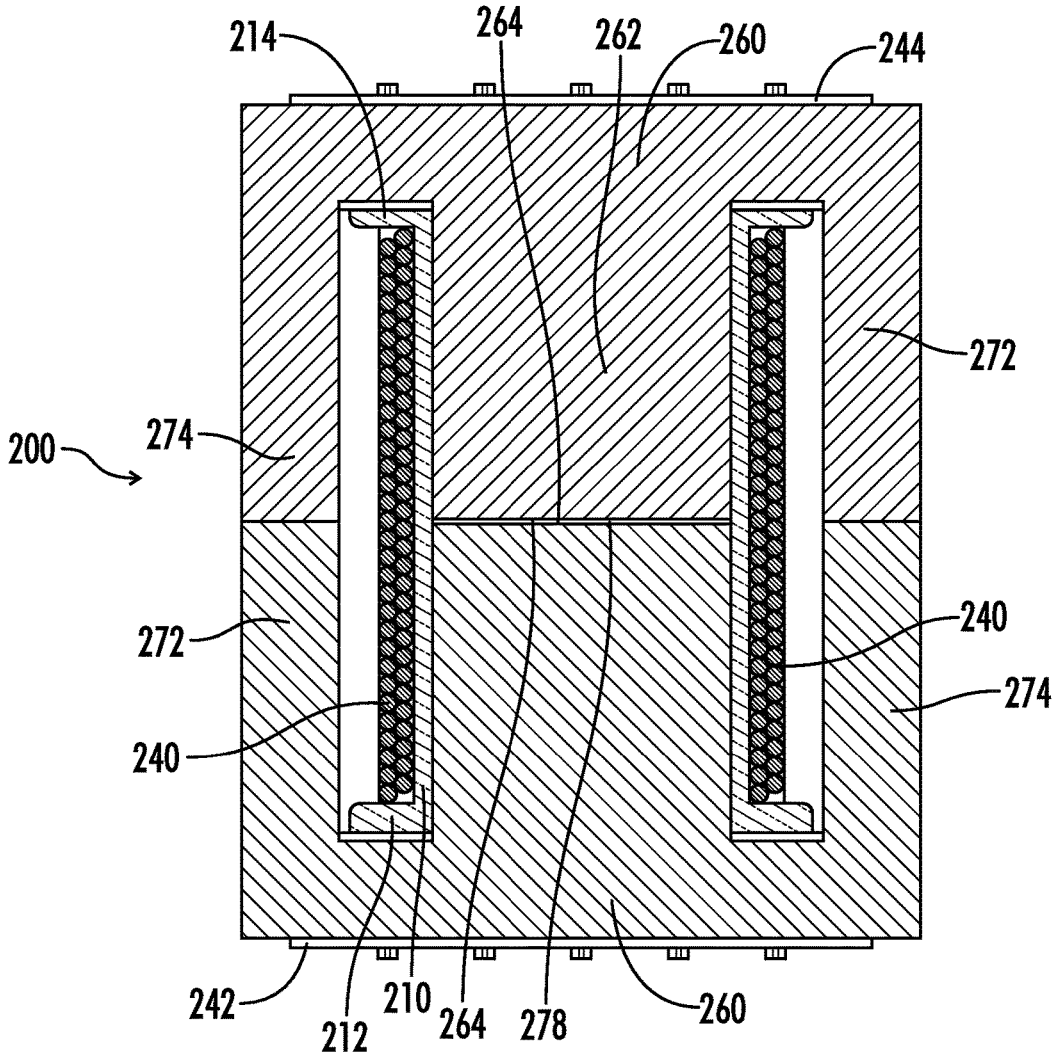
FIG. 6 (PRIOR ART)
FIG. 6 illustrates a cross-sectional upper plan view of the assembly of FIG. 4 taken along line 6-6 in FIG. 4.

FIG. 4 illustrates a perspective view of a conventional "low profile" magnetic assembly 200. FIG. 5 illustrates an exploded perspective view of the assembly of FIG. 4. FIG. 6 illustrates a cross-sectional upper plan view of the assembly of FIG. 4 taken along the lines 6-6 in FIG. 4.

The magnetic assembly 200 includes a bobbin 210, having a first end flange 212 and a second end flange 214. The first end flange 212 as an inner surface 220 and an outer surface 222. The second end flange 214 has an inner surface 224 and an outer surface 226. A longitudinal passageway 230 extends from the outer surface 222 of the first end flange to the outer surface 226 of the second end flange 214. The passageway 230 has a cross-sectional profile. In the illustrated assembly, the profile is generally rectangular. The bobbin further includes a winding 240 defined by a plurality of turns of an electrically conductive wire (e.g., copper wire) wound around the passageway 230 between the inner surfaces of the end flanges in a conventional manner. Only the protective outer covering of the winding is shown in FIGS. 4 and 5. The first end flange 212 is supported by a first base platform 242. The second end flange 214 is supported by a second base platform 244. The base platforms include a plurality of contact pins 246 that are useable to mount the magnetic assembly to a circuit board (not shown). Some or all of the contact pins 246 are electrically connected to the winding to provide electrical communication from the winding to a circuit board.

As shown in FIG. 5, the magnetic assembly 200 further includes a first E-core 250 made from a ferromagnetic material, such as, for example, silicon steel, and a second E-core 252 of similar construction. Each E-core has a base portion 260 with a center leg 262 extending perpendicularly from the middle of the base portion 260. The center leg 262 has a mating face 264. A first outer leg 270 extends from a first end of the base portion 260 in parallel with the center leg. The first outer leg 270 has a mating face 272. A second outer leg 274 extends from a second end of the base portion 260 in parallel with the center leg 262 and the first outer leg 270. The second outer leg 274 has a mating face 276 When the respective center legs of the two E-cores are installed in the passageway 230 from opposite ends of the bobbin 210, the respective mating faces of the outer legs engage as illustrated in FIG. 4 to provide a continuous magnetic circuit around the outer legs and the base portions. The respective center legs of the two E-cores are shorter longitudinally (e.g., in the distance away from the base portions) than the respective outer legs. The center legs may be made shorter than the outer legs by grinding or other conventional techniques. Because of the shortness of the center legs, when the mating faces of the two outer legs engage, the mating faces of the center legs are spaced apart by a selected distance to form a gap 278 (FIG. 6) in the magnetic path through the center legs. In the illustrated conventional magnetic assembly the gap 278 is positioned substantially in the middle of the longitudinal passageway and is thus directly beneath the middle of the winding 240. As discussed above, the positioning of the gap in the middle of the passageway allows stray magnetic fields to interfere with the winding and cause unwanted loss in the winding.

The magnetic assembly 200 of FIGS. 4, 5 and 6 is referred to herein as a "low profile" magnetic assembly. As shown in FIG. 5, the heights of the center legs 264 of the E-cores 250, 252 are less than the heights of the base portions 260 and the heights of the first outer legs 270 and the second outer legs 274. Thus, the passageway 230 has a height to accommodate the smaller heights of the center legs. When the magnetic assembly is assembled as shown in FIG. 3 with the center legs in the passageway of the bobbin, the end flanges of the bobbin extend only a relatively short distance above and below the E-cores in comparison to distances shown in FIG. 1. Thus, the magnetic assembly is "low profile" with respect to the heights of the E-cores.

As illustrated, the embodiment of FIGS. 1-3 has two E-cores 150, 152; and the embodiment of FIGS. 4-6 also has two E-cores 250, 252. When the embodiments are assembled, the two E-cores in each assembly have to be secured to each other so that the respective mating faces of the outer legs are engaged to complete the magnetic path around the outer legs and the base portions. Furthermore, the outer legs must be engaged to establish a desired gap distance between the mating faces of the central legs within the respective passageways 130, 230. In conventional magnetic assemblies, the E-cores are secured by winding tape around the outer legs and the base portions or by gluing the mating faces of the outer legs. Both techniques require additional assembly steps. The gluing technique also requires additional manufacturing time while the glue sets. Furthermore, unless the E-cores are initially formed with shorter central legs, each central leg must be ground to shorten the central leg by a distance corresponding to one half of the gap distance.

Figure 7:
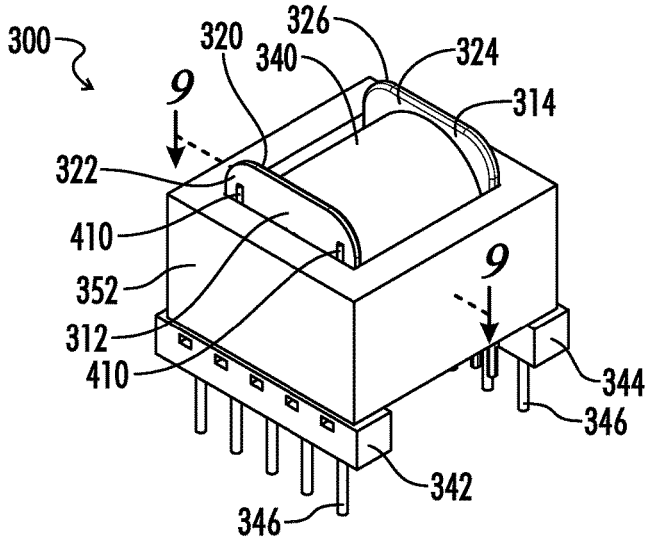
FIG. 7 illustrates a perspective view of a "tall" magnetic assembly in accordance with improvements disclosed herein.
Figure 8:
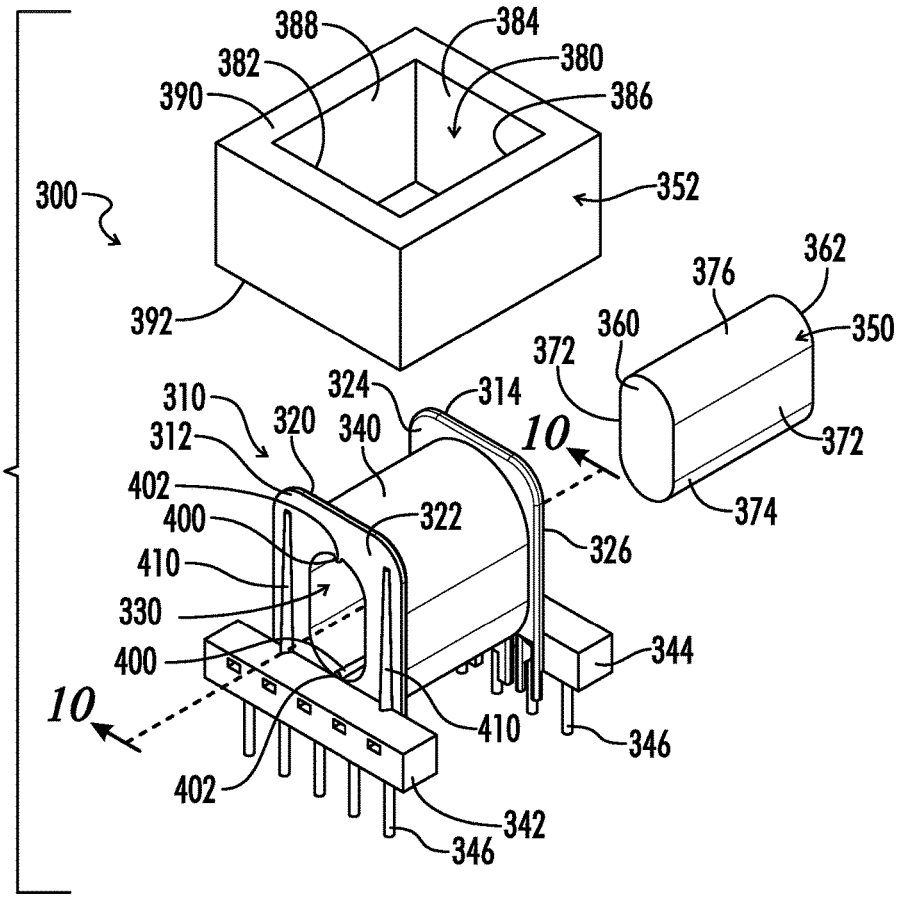
FIG. 8 illustrates an exploded perspective view of the magnetic assembly of FIG. 7.
Figure 9:
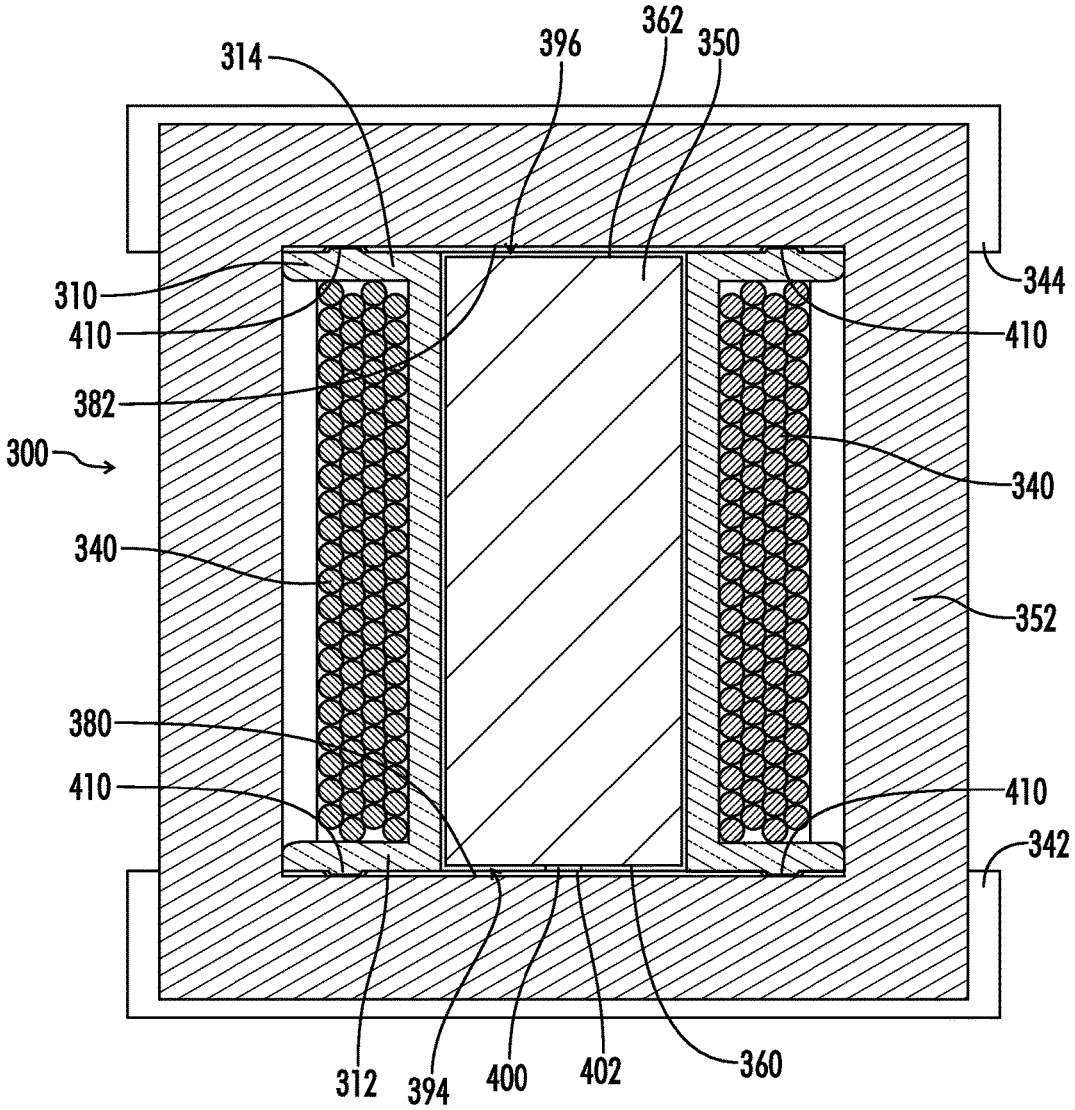
FIG. 9 illustrates a cross-sectional upper plan view of the assembly of FIG. 7 taken along line 9-9 in FIG. 7.
Figure 10:
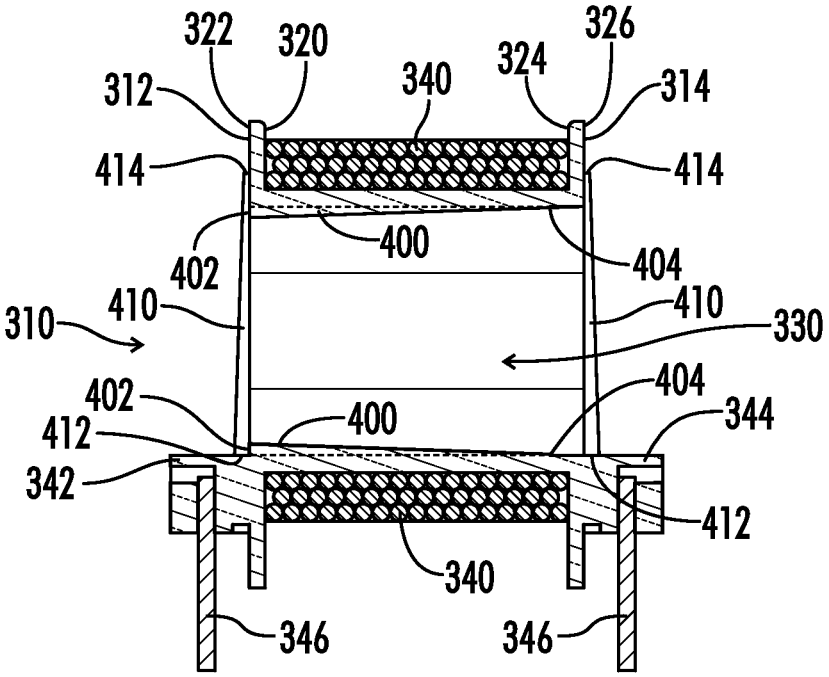
FIG. 10 illustrates a cross-sectional elevational view of the bobbin of FIG. 8 taken along line 10-10 in FIG. 8.
Figure 11:
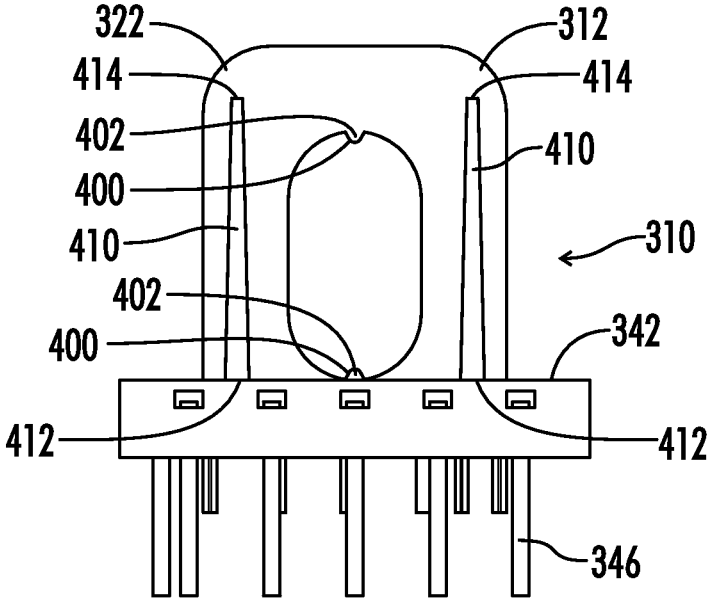
FIG. 11 illustrates a front elevational view of the front of the bobbin of FIG. 8 before inserting the center core.
Figure 12:
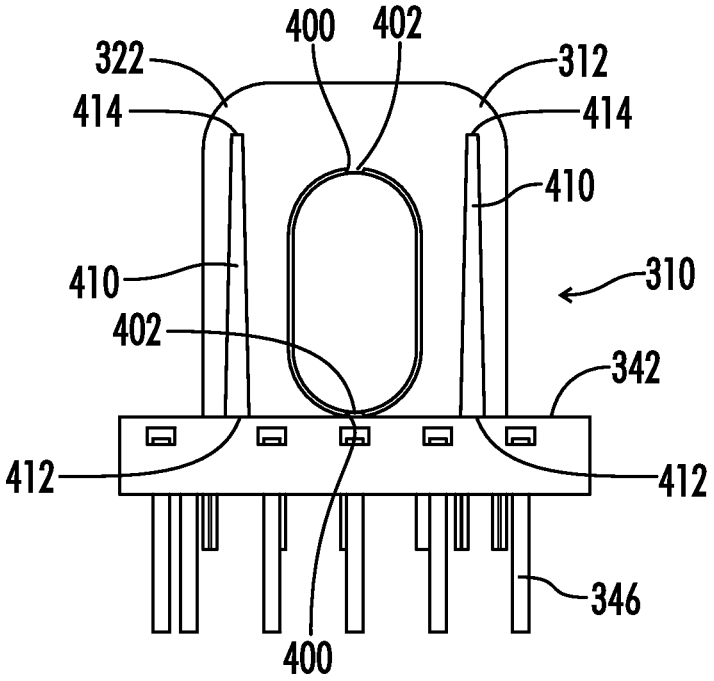
FIG. 12 illustrates the front elevational view of the bobbin of FIG. 8 after inserting the center core.

FIG. 7 illustrates a perspective view of a "tall" magnetic assembly 300 in accordance with the present invention. FIG. 8 illustrates an exploded perspective view of the magnetic assembly of FIG. 7. FIG. 9 illustrates a cross-sectional upper plan view of the assembly of FIG. 7 taken along the lines 9-9 in FIG. 7. FIG. 10 illustrates a cross-sectional elevational view of the bobbin of FIG. 8 taken along the lines 10-10 in FIG. 8. FIG. 11 illustrates a front elevational view of the front of the bobbin of FIG. 8 before inserting the center core. FIG. 12 illustrates the front elevational view of the bobbin of FIG. 8 after inserting the center core.

The magnetic assembly 300 of FIGS. 7-12 includes a bobbin 310 having a first end flange 312 and a second end flange 314. In the illustrated embodiment, the bobbin comprises 310 may be formed from commercially available Nylon 6/6 (also known as Nylon 66, Nylon 6-6 or Nylon 6,6). The first end flange 312 has an inner surface 320 and an outer surface 322. The second end flange 314 has an inner surface 324 and an outer surface 326. A longitudinal passageway 330 extends from the outer surface 322 of the first end flange 312 to the outer surface 326 of the second end flange 314. The passageway 330 has a cross-sectional profile, which, in the illustrated assembly, is generally oval shaped. As used herein, "oval shaped" includes, but is not limited to, the shape shown in FIG. 8, which has two parallel, generally straight side walls with arcuate (e.g., semicircular or elliptical) end walls. Thus, the profile has an appearance similar to a racetrack "oval." In FIG. 8, the straight side walls of the passageway 330 are positioned vertically, and the arcuate end walls form the top and bottom of the passageway. In alternative embodiments, the profile may be generally rectangular with 90-degree transitions between the sides or may have fillets at the transitions. The profile illustrated herein has certain advantages that are described below with respect to FIGS. 13A and 13B.

The bobbin 310 further includes a winding 340, defined by a plurality of turns of an electrically conductive wire (e.g., copper wire) wound around the passageway between the inner surfaces of the end flanges in a conventional manner. Only the protective outer covering of the winding is shown in FIGS. 7 and 8. The first end flange 312 is supported by a first base platform 342. The second end flange 314 is supported by a second base platform 344. The base platforms include a plurality of contact pins 346 that are useable to mount the magnetic assembly to a circuit board (not shown). Some or all of the contact pins are electrically connected to the winding to provide electrical communication from the winding to the circuit board.

As illustrated in FIGS. 7-12, the magnetic assembly 300 also includes an inner core 350 and an outer core 352 instead of the two E-cores shown the previously described conventional magnetic core assemblies 100, 200.

In the illustrated embodiment, the inner core 350 has a single linear section of a ferromagnetic material, such as, for example, a sintered ferrite core of iron, manganese and zinc. The inner core 350 has a longitudinal length between a first end surface 360 and a second end surface 362 that is less than or equal to the longitudinal length of the passageway 330. When the inner core 350 is centered within the passageway 330, the first end surface is proximate to the first end flange 312, and the second end surface is proximate to the second end flange 314. In embodiments where the longitudinal length of the inner core 350 is the same as the longitudinal length of the passageway 330, the first and second end surfaces of the inner core 350 may be flush with the outer surface 322 of the first end flange 312 and the outer surface 326 of the second end flange 314. In other embodiments where the longitudinal length of the inner core is less than the longitudinal length of the passageway, the first and second end surfaces may be recessed by a small amount from the respective outer surfaces of the flanges. For example, in the illustrated embodiment, the longitudinal length of the inner core 350 is approximately 0.01 inch shorter than the longitudinal length of the passageway 330, and each end surface of the inner core is recessed by approximately 0.005 inch from the respective outer surface of the respective end flange.

The inner core 350 has a profile defined by a first vertical side surface 370, a second vertical side surface 372, an arcuate lower surface 374 and an arcuate upper surface 376. The profile of the inner core 350 is selected to conform to the profile of the passageway 330 (e.g., a profile having a "racetrack" oval shape). The width and height of the inner core 350 are selected to be slightly smaller than the width and height of the passageway so that the inner core fits snugly within the passageway when inserted from the outer surface 326 of the second end flange 314. As used herein, "snugly" or "snug-fit" is used to indicate that the inner core fits within the passageway 330 with zero or very little tolerance so that the inner core can be pressed into the passageway but is not readily removable from the passageway. The embodiment of FIGS. 7-12 includes additional features described below to assure that the inner core remains in a fixed position within the passageway.

In the illustrated embodiment, the outer core 352 is a rectangular parallelepiped with a hollow inner cavity 380 sized to receive the bobbin 310. The outer core 352 has a continuous wall of a ferromagnetic material (e.g., a sintered ferrite core of iron, manganese and zinc) that surrounds the hollow inner cavity 380. The hollow inner cavity 380 of the outer core 352 is defined by a first inner surface 382 and a parallel second inner surface 384. The first and second inner surfaces are perpendicular to a third inner surface 386 and to a fourth inner surface 388. The third and fourth inner surfaces are spaced apart by a distance selected to be substantially equal to a width of each of the first end flange 312 and the second end flange 314 of the bobbin so that the outer core is positionable on the bobbin with the third and fourth inner surfaces abutted against the end flanges as shown in FIG. 7. The outer core further has an upper surface 390 and a lower surface 392. In the illustrated embodiment, the first and second inner surfaces have lengths approximately equal to the lengths of the third and fourth inner surfaces such the overall shape of the rectangular outer core is generally square as shown in the drawings. The lengths of the inner surfaces are determined by the length of the bobbin and by the widths of the end flanges. Accordingly, certain embodiments may have rectangular outer cores with different lengths of the first and second inner surfaces with respect to the lengths of the third and fourth inner surfaces.

The first inner surface 382 and the second inner surface 384 of the outer core 352 are spaced apart by a distance greater than the longitudinal length of the passageway 330. When the outer core 352 is positioned on the bobbin 310 as shown in FIG. 7 and is centered with respect to the longitudinal length of the passageway 330, the first inner surface of the outer core is spaced apart from the first end surface 360 of the inner core 350 by a first distance to form a first gap 394, and the second inner surface of the outer core is spaced apart from the second end surface 362 of the inner core by a second distance to form a second gap 396. Preferably, the first distance and the second distance are substantially equal. The two gaps provide a similar benefit to the single gap between the two center legs 162 of the conventional E-core magnetic assembly 100 of FIGS. 1-3. However, the gaps are outside the winding 340. Thus, any stray magnetic fields caused by the gaps have less influence on the winding.

The sizes of the gaps 394, 396 are determined by the difference between the length of the inner core 350 and the longitudinal distance between the first inner surface 380 and the second inner surface 382 of the outer core 352. Accordingly, the sizes of the gaps can be adjusted by selecting the length of the inner core with respect to the distance between the first and second inner surfaces of the outer core.

In the illustrated embodiment of FIGS. 7-12, the cross-sectional profile of rectangular outer core 352 has a height between the upper surface 390 and the lower surface 392 similar to the height of the inner core 350. In the illustrated embodiment, the width of the cross-sectional profile of the rectangular outer core 352 is approximately one-half the width of the inner core 350. As illustrated the height of the rectangular outer core 352 is less than the height of the first end flange 312 and the second end flange 314. Thus, the tops of the end flanges extend a substantial distance above the upper surface 390 of the outer core 352 such that the overall height of the magnetic assembly 300 is substantially greater than the height of the rectangular outer core 352. Accordingly, the magnetic assembly is considered to be a "tall" magnetic assembly.

As further illustrated in FIGS. 8-12, the passageway 330 of the bobbin 310 includes a plurality of passageway ribs 400. In the illustrated embodiment, two passageway ribs 400 are provided with a first rib positioned in the bottom of the passageway and a second rib positioned in the top of the passageway. Each passageway rib 400 is configured as a generally triangular protuberance with a base at the respective top or bottom and with a vertex extending into the passageway 330. In the illustrated embodiment, the vertex of each passageway rib 400 is rounded as shown in the front elevational view of FIG. 11. As shown in the elevational cross-sectional view of FIG. 10 and the cross-sectional plan view of FIG. 9, each passageway rib 400 tapers from a first thickness and a first width at a first end 402 proximate to the first end flange 312 to a relatively small second thickness and a relatively small second width at a second end 404 near the second end flange 314. In the illustrated embodiment, the taper is generally continuous from the first end to the second end of the rib 400. In alternative embodiments, an initial portion of the rib 400 proximate to the first end can be untapered with a portion of the rib proximate to the second end being tapered. For example, in the illustrated embodiment, each passageway rib 400 has a maximum height of approximately 0.020 inch proximate the first end flange 312 and tapers to a height of approximately 0.003 inch near the second end flange 314. Similarly, each passageway rib 400 has a maximum width at the base of approximately 0.034 inch proximate the first end flange 312 and tapers to a width of approximately 0.007 near the second end flange 314.

In the illustrated embodiment, the passageway 330 has a longitudinal length between the outer surface 322 of the first end flange and the outer surface 326 of the second end flange of approximately 0.551 inch, and each passageway rib has longitudinal length of approximately 0.515 inch. In the illustrated embodiment, each passageway rib extends from outer surface of the first end flange and terminates approximately 0.036 inch from the outer surface of the second end flange.

The inner core 350 is positioned in the passageway 330 by inserting the first end surface 360 of the inner core into the passageway at the outer surface 326 of the second end flange 314. Pressure is applied to the second end surface 362 of the inner core to force the inner core into the passageway. As the first end surface 360 of the inner core 350 is pressed into the passageway 330, the inner core 350 initially rides upon the shorter (vertically) portions of the upper and lower passageway ribs 400 and then begins to crush the ribs as the first end surface of the inner core presses further toward the outer surface 322 of the first end flange 312 of the bobbin 310 and encounters the portions of the passageway ribs of increasingly greater height. In certain embodiments, the inner core 350 is positioned such that the end surfaces of the inner core are positioned by approximately the same distance from the respective outer surfaces of the end flanges (e.g., either flush with the respective outer surfaces or recessed by approximately the same distance from the respective outer surfaces). After the inner core 350 is positioned and the pressure is removed from the second end, the resilience of the crushable rib presses against the top and bottom surfaces of the inner core to securely retain the inner core in a fixed longitudinal position within the passageway. As a result, the inner core 350 is substantially centered in the passageway between the upper and lower passageway ribs as shown in the front elevational view of FIG. 12.

As further illustrated in FIGS. 7-12, the bobbin 310 of the magnetic assembly 300 further includes a plurality of outer positioning ribs 410 on the outer surface 322 of the first end flange 312 and on the outer surface 326 of the second end flange 314. In the illustrated embodiment, each outer surface includes two outer positioning ribs for a total of four positioning ribs. One outer positioning rib is positioned on either side of the opening to the passageway 330 on each outer surface. Each outer positioning rib extends from a respective base end 412 at an intersection of the respective outer surface with the respective base platform 342, 344 and extends to a respective terminal end 414 near the top of the respective outer surface. Each outer positioning rib tapers to an increasingly smaller size from the respective base end to the respective terminal end. In the illustrated embodiment, the taper is generally continuous from the base end to the terminal end of the rib. In alternative embodiments, an initial portion of the rib proximate to the base end can be untapered with a portion of the rib proximate to the terminal end being tapered. For example, in the illustrated embodiment, each outer positioning rib tapers from an initial width (along the respective outer face) of approximately 0.035 inch and an initial thickness (outward from the respective outer face) of approximately 0.024 inch to a terminal width of approximately 0.009 inch and a terminal thickness of approximately 0.005 inch. In the illustrated embodiment, each rib has a length of approximately 0.57 inch, and the end flanges have respective heights of approximately 0.868 inch.

The four outer positioning ribs 410 position and secure the rectangular outer core 352 with respect to the bobbin 310. During an assembly process, the rectangular outer core 352 is initially positioned over the bobbin near the tops of the first end flange 312 and the second end flange 314 with the first inner surface 370 and the second inner surface 372 of the rectangular outer core 352 proximate to the respective upper terminal ends 414 of the outer positioning ribs. Pressure is applied to the upper surface 390 of the rectangular outer core 352 to force the rectangular outer core downwardly onto the outer positioning ribs until the lower surface 392 of the rectangular outer core abuts the tops of the base platforms 342, 344. The downward movement causes the outer positioning ribs 410 to crush such that when the force is removed, the rectangular outer core 352 is secured by the outward force of the resilient outer positioning ribs 410.

The outer positioning ribs 410 on the outer surface 322 of the first end flange 312 and the outer surface 326 of the second end flange 314 are substantially symmetrical with respect to the longitudinal center of the passageway 330. Thus, the rectangular outer core 352 is substantially centered with respect to the bobbin 310 such that the first inner surface 380 and the second inner surface 382 of the rectangular outer core 352 are spaced apart respectively from the outer surface of the first end flange and the outer surface of the second end flange by substantially equal distances from the outer surfaces. Accordingly, the gaps 394, 396 are substantially equal as shown.

As described above, the passageway ribs 400 and the outer positioning ribs 410 enable a quick and simple manufacturing process. The inner core 350 is press fit into the passageway 330 of the bobbin 310 and is retained in a fixed location by the pressure of the resilient crushed passageway ribs. The outer core 352 is press fit onto the first end flange 312 and the second end flange 314 of the bobbin and is retained in a fixed location by the pressure of the crushed outer positioning ribs. The passageway ribs and the outer positioning ribs assure that the first end surface 360 and the second end surface 362 of the inner core are properly positioned with respect to the first inner surface 380 and the second inner surface 382, respectively, by a selected fixed distance to produce the desired spacing for each of the first gap 394 and the second gap 396. Unlike the previously described conventional E-core magnetic assemblies 100, 200, no gluing, taping or other additional steps are required to complete the assembly process.

Figure 13A:
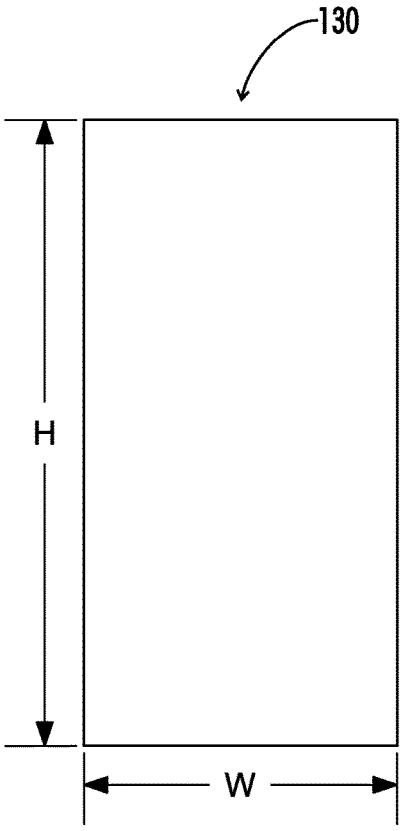
FIG. 13A is a pictorial representation of the elevational end view of the passageway of the embodiment of FIGS. 1-3 annotated to represent a turn of the winding around the passageway.
Figure 13B:
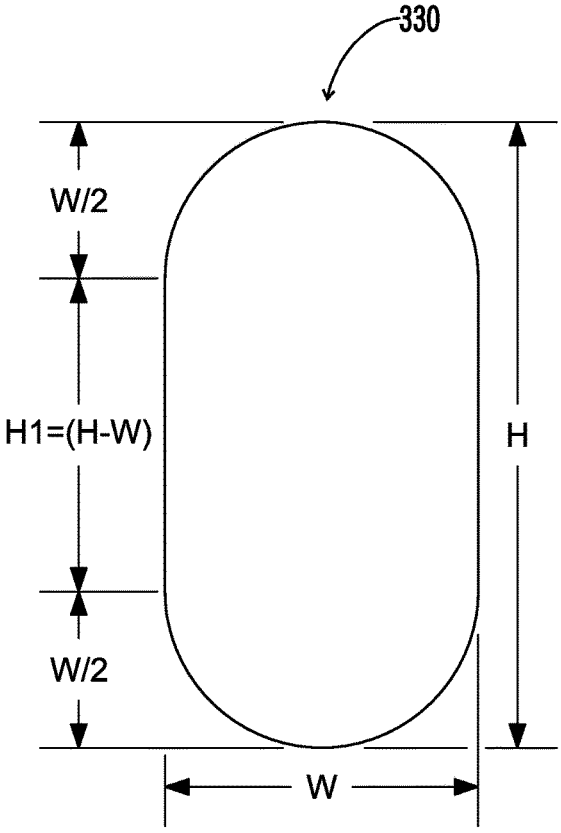
FIG. 13B is a pictorial representation of the elevational end view of passageway of the embodiment of FIGS. 7-12 annotated to represent a turn of the winding around the passageway.

The oval shaped passageway 330 of FIG. 8 also provides a wiring advantage over the generally rectangular passageway 130 of FIG. 2 and the generally rectangular passageway 230 of FIG. 5. The advantage is illustrated in FIGS. 13A and 13B, wherein the profile of the conventional passageway 130 of FIG. 2 is shown in FIG. 13A and the profile of the improved passageway 330 of FIG. 8 is shown in FIG. 13B. Both profiles have the same overall height (H) and overall width (W). As shown in FIG. 13A, the conventional passageway has 90-degree transitions between the sides and the top and between the sides and the bottom. Each 90-degree bend causes stress on the copper wire in the winding. Furthermore, the windings around the conventional rectangular passageway are longer than the windings around the improved oval shaped passageway. As illustrated in FIG. 13B, the total distance around the improved oval shaped passageway is $(2\times H1)+(\pi\times W)$, where H1 is equal to H−W. Using the same designations, the total distance around the conventional rectangular passageway is $(2\times H1)+(4W)$. Thus, the distance around the improved oval shaped passageway is $(4-\pi)\times W$ less than the distance around the corresponding rectangular passageway having the same overall height and width. The reduced winding distance saves approximately $(4-\pi)\times W$ or approximately $0.85\times W$ of wire for each turn of the winding. For example, if W is approximately 0.24 inch, the oval shaped passageway saves approximately 0.2 inch of copper wire per turn with a commensurate reduction in weight. It should be understood that numbers used for the foregoing example are based on the first winding layer. The numbers will be different for subsequent winding layers as the overall winding becomes taller and wider.

Figure 14:
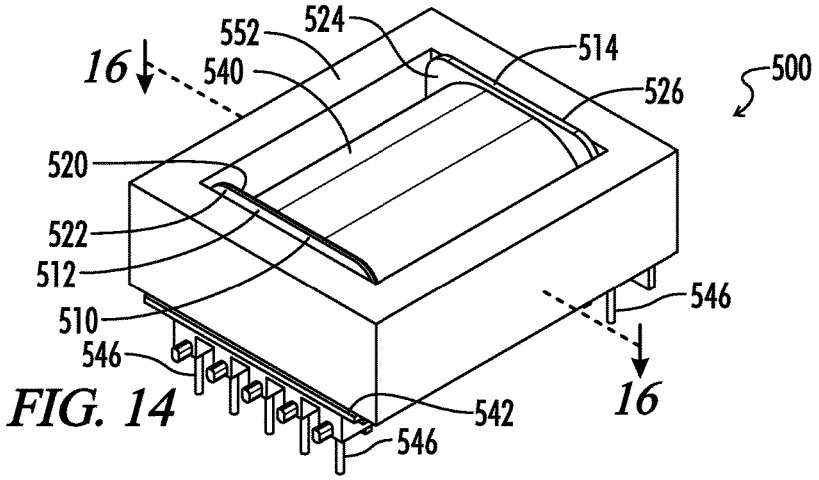
FIG. 14 illustrates a perspective view of a "low profile" magnetic assembly in accordance with improvements disclosed herein.
Figure 15:
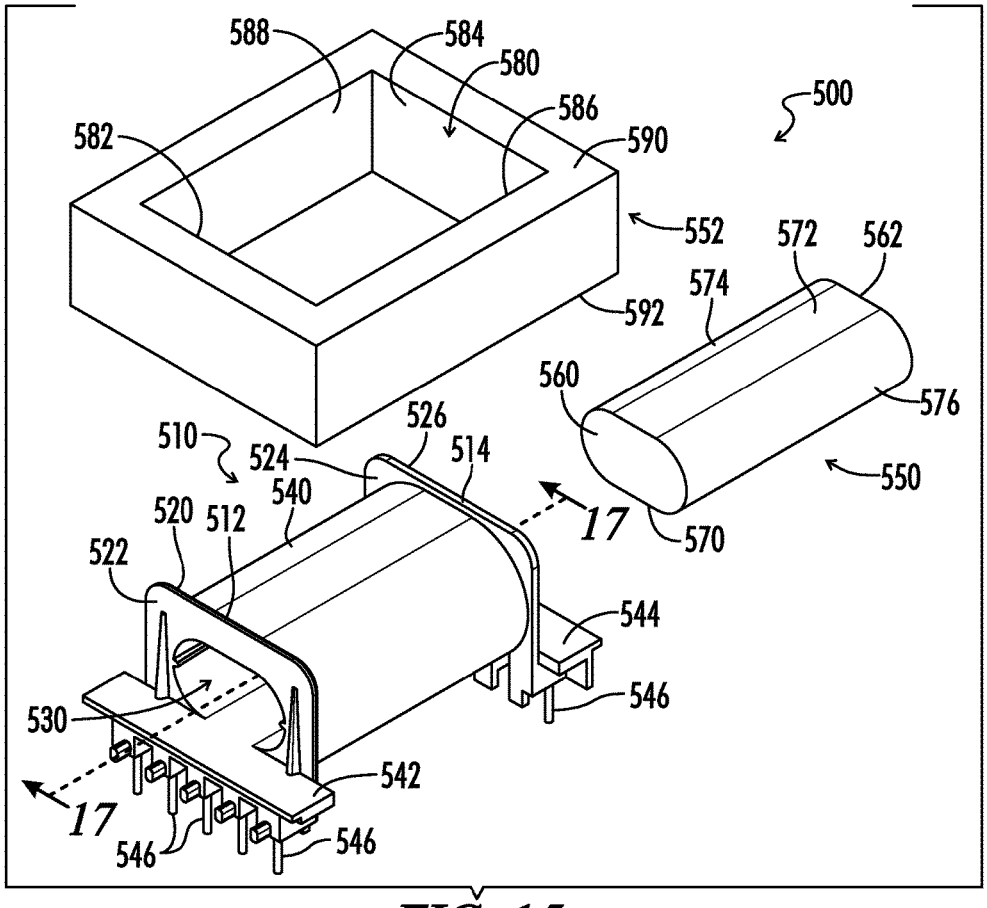
FIG. 15 illustrates an exploded perspective view of the magnetic assembly of FIG. 14.
Figure 16:
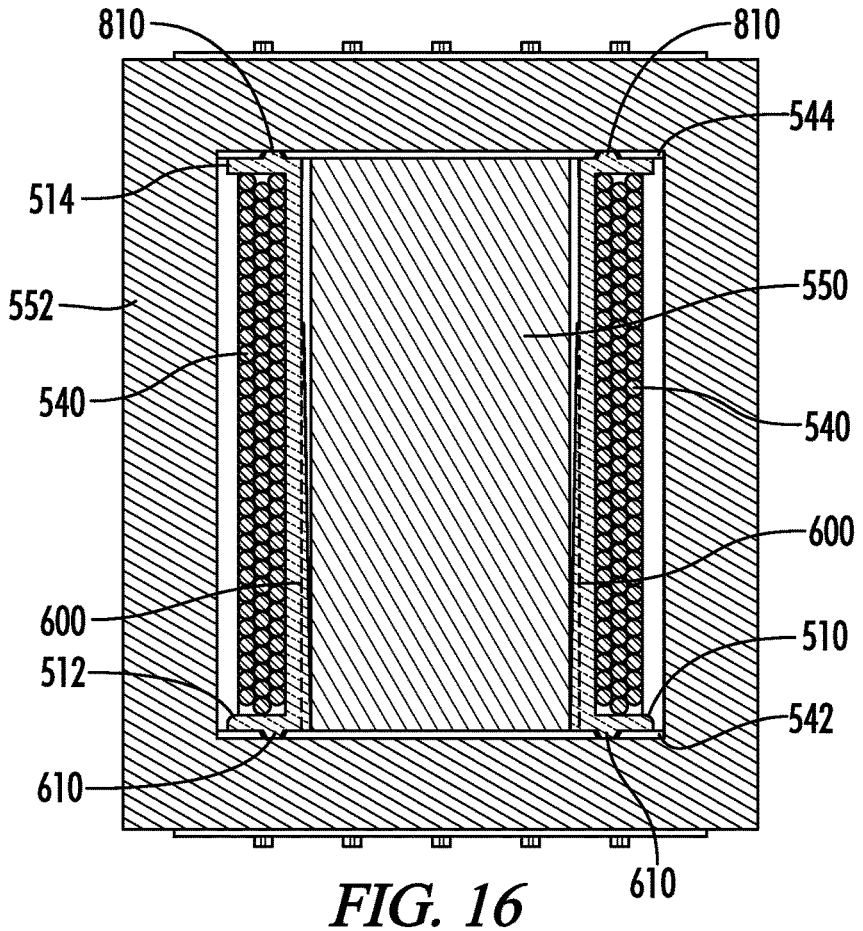
FIG. 16 illustrates a cross-sectional upper plan view of the assembly of FIG. 14 taken along line 16-16 in FIG. 14.
Figure 17:
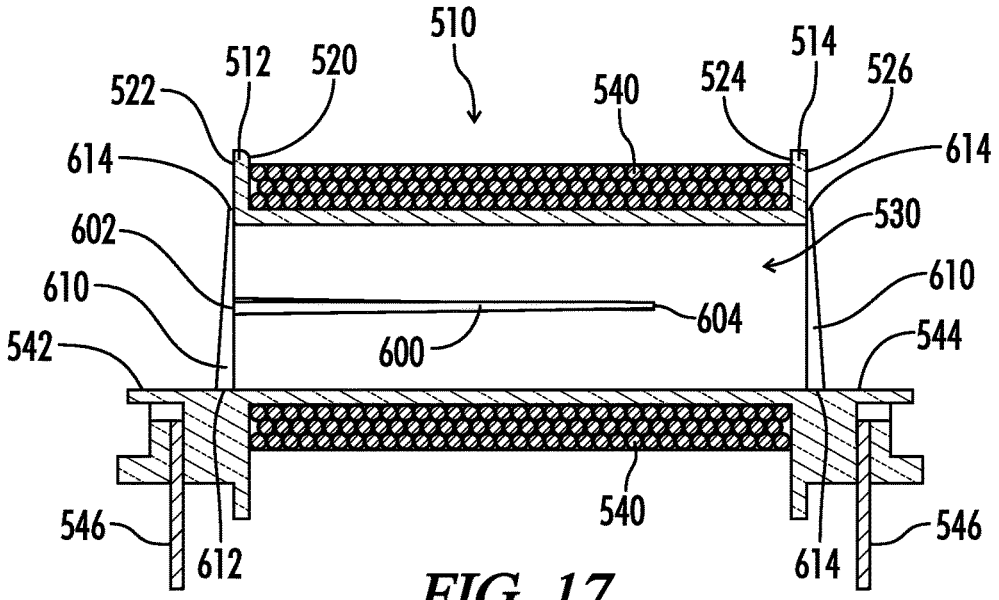
FIG. 17 illustrates a cross-sectional elevational view of the bobbin of FIG. 15 taken along line 17-17 in FIG. 15.
Figure 18:
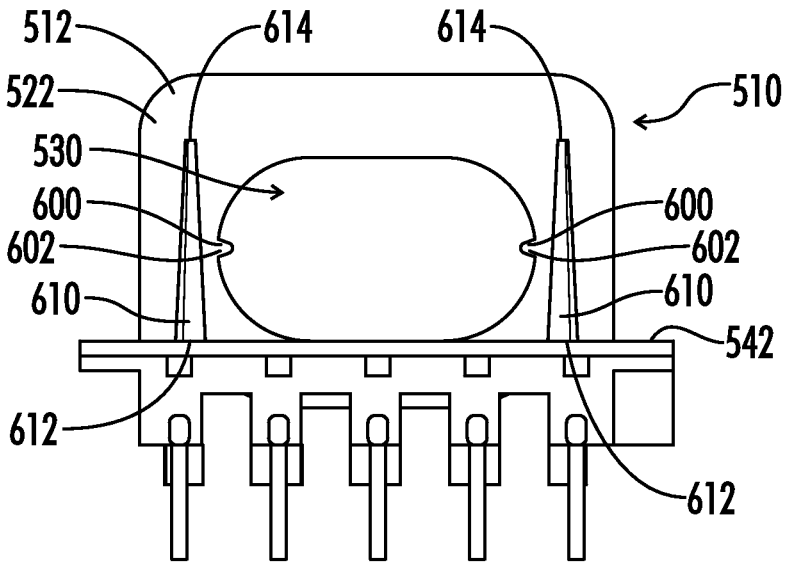
FIG. 18 illustrates a front elevational view of the front of the bobbin of FIG. 15 before inserting the center core.
Figure 19:
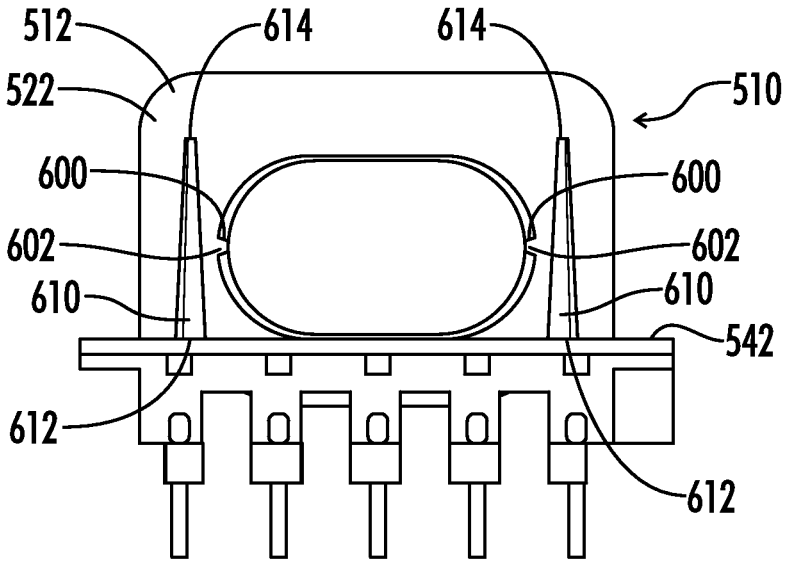
FIG. 19 illustrates the front elevational view of the bobbin of FIG. 15 after inserting the center core.

FIG. 14 illustrates a perspective view of a "low profile" magnetic assembly 500 in accordance with improvements disclosed herein. FIG. 15 illustrates an exploded perspective view of the magnetic assembly of FIG. 14. FIG. 16 illustrates a cross-sectional upper plan view of the assembly of FIG. 14 taken along the lines 16-16 in FIG. 14. FIG. 17 illustrates a cross-sectional elevational view of the bobbin of FIG. 15 taken along the lines 17-17 in FIG. 15. FIG. 18 illustrates a front elevational view of the front of the bobbin of FIG. 14 before inserting the central core. FIG. 19 illustrates the front elevational view of FIG. 18 after inserting the central core.

The magnetic assembly 500 of FIGS. 14-19 includes a bobbin 510, which includes a first end flange 512 and a second end flange 514. In the illustrated embodiment, the bobbin 510 may be formed from nylon as described above with respect to the bobbin 310. The first end flange 512 has an inner surface 520 and an outer surface 522. The second end flange 514 has an inner surface 524 and an outer surface 526. A longitudinal passageway 530 extends from the outer surface of the first end flange to the outer surface of the second end flange. The passageway 530 has a cross-sectional profile. In the illustrated assembly, the profile is generally oval shaped similar to the profile described above for the passageway 330 except that the profile of the passageway 530 is rotated 90 degrees such that the straight walls of the passageway are positioned horizontally and form the top wall and bottom wall of the passageway. The left and right end walls of the passageway are arcuate (e.g., semicircular in the illustrated embodiment). The oval-shaped passageway of the embodiment of FIGS. 14-19 provides a similar advantage over the conventional rectangular passageway as described above with respect to FIGS. 13A and 13B.

The bobbin 510 further includes a winding 540 similar to the winding 340 described above. Only the protective outer covering of the winding is shown in FIGS. 14 and 15. The first end flange 512 is supported by a first base platform 542. The second end flange 514 is supported by a second base platform 544. The base platforms include a plurality of contact pins 546 that are useable to mount the magnetic assembly to a circuit board (not shown). Some or all of the contact pins are electrically connected to the winding to provide electrical communication from the winding to the circuit board.

As illustrated in FIGS. 14-19, the magnetic assembly 300 has an inner core 550 and an outer core 552 similar to the inner core 350 and the outer core 352 of FIGS. 7-12. However, as described below, the inner core 550 is sized and oriented to provide a low profile magnetic assembly.

The inner core 550 has a longitudinal length between a first end surface 560 and a second end surface 562 that is less than or equal to the longitudinal length of the passageway 530. When the inner core 550 is centered within the passageway 530, the first end surface is proximate to the first end flange 512, and the second end surface is proximate to the second end flange 514. In embodiments where the longitudinal length of the inner core 550 is the same as the longitudinal length of the passageway 530, the first and second end surfaces of the inner core 550 may be flush with the outer surface 522 of the first end flange 512 and the outer surface 526 of the second end flange 514. In other embodiments where the longitudinal length of the inner core 550 is less than the longitudinal length of the passageway 530, the first and second end surfaces may be recessed by a small amount from the respective outer surfaces of the flanges. For example, in the illustrated embodiment, the longitudinal length of the inner core is approximately 0.01 inch shorter than the longitudinal length of the passageway, and each end surface of the inner core is recessed by approximately 0.005 inch from the respective outer surface of the respective end flange.

The inner core 550 has a profile defined by a first horizontal bottom surface 570, a second horizontal top surface 572, a curved left side surface 574 and a curved right side surface 576. The profile of the inner core 550 is selected to conform to the profile of the passageway 530 (e.g., a "racetrack" oval shape similar to the inner core 350 of FIGS. 7-12, with the straight sides rotated 90 degrees). The width and height of the inner core 550 are selected to be slightly smaller than the width and height of the passageway so that the inner core fits barely within the passageway when inserted from the outer surface of the second end flange.

In the illustrated embodiment, the outer core 552 is a rectangular parallelepiped with a hollow inner cavity 580 sized to receive the bobbin 510. The outer core 552 may have a continuous wall of a ferromagnetic material (e.g., a sintered ferrite core of iron, manganese and zinc) that surrounds the hollow inner cavity 580. The hollow inner cavity 580 of the outer core 552 is defined by a first inner surface 582 and a parallel second inner surface 584. The first and second inner surfaces are perpendicular to a third inner surface 586 and to a fourth inner surface 588. The third and fourth inner surfaces are spaced apart by a distance selected to be substantially equal to a width of each of the first end flange 512 and the second end flange 514 so that the outer core is positionable on the bobbin 510 with the third and fourth inner surfaces abutted against the end flanges as shown in FIG. 14. The outer core further 552 has an upper surface 590 and a lower surface 592.

The first inner surface 580 and the second inner surface 582 of the outer core 552 are spaced apart by a distance greater than the longitudinal length of the passageway 530. When the outer core 552 is positioned on the bobbin 510 as shown in FIG. 14 and is centered with respect to the longitudinal length of the passageway 530, the first inner surface of the outer core is spaced apart from the first end surface 560 of the inner core 550 by a first distance to form a first gap 594, and the second inner surface of the rectangular core is spaced apart from the second end surface 562 of the inner core by a second distance to form a second gap 596. Preferably, the first distance and the second distance are substantially equal. The two gaps provide benefits described above in connection with the embodiment of FIGS. 7-12.

In the illustrated embodiment, the cross-sectional profile of rectangular outer core 552 has a height between the upper surface 590 and the lower surface 592 similar to the height of the rectangular outer core 352 of the embodiment of FIGS. 7-12; however, the inner core 550 has a height between the first horizontal bottom surface 570 and the second horizontal top surface 572 that is shorter than the height of the rectangular outer core 552. For example, the height of the inner core 550 may be in a range of one-half to three-quarters of the height of outer core. The overall height of the bobbin 510 is determined in part by the height of the inner core 550 and is much shorter than the height of the bobbin 310 because of the rotated orientation of the inner core in FIGS. 14-19. Thus, when the rectangular outer core 552 is positioned around first end flange 512 and the second end flange 514 of the bobbin 510, only a small portion of each end flange extends above upper surface of the rectangular outer core. Accordingly, the magnetic assembly 500 of FIGS. 14-19 is considered to be a "low profile" magnetic assembly.

As further illustrated in FIGS. 14-19, the passageway 530 of the bobbin 510 includes a plurality of passageway ribs 600. In the illustrated embodiment, two passageway ribs 600 are provided with a first rib positioned in the bottom of the passageway and with a second rib positioned in the top of the passageway. Each passageway rib 600 is configured as a generally triangular protuberance with a base at the respective top or bottom and with a vertex extending into the passageway 530. In the illustrated embodiment, the vertex of each passageway rib 600 is rounded as shown in the front elevational view of FIG. 18. As shown in the elevational cross-sectional view of FIG. 17 and the cross-sectional plan view of FIG. 16, each passageway rib 600 tapers from a first thickness and a first width at a first end 502 proximate to the first end flange 512 to a relatively small second thickness and a relatively small second width at a terminal end 504 near the second end flange 514. The passageway ribs 600 of this embodiment have similar widths, heights and lengths to the corresponding widths, heights and lengths of the passageway ribs 400 of the embodiment of FIGS. 7-12, and extend between the end flanges in a similar manner. In the illustrated embodiment, the taper is generally continuous from the first end to the second end of the rib. In alternative embodiments, an initial portion of the rib proximate to the first end can be untapered with a portion of the rib proximate to the second end being tapered.

The inner core 550 is positioned in the passageway 530 by inserting the first end surface 560 of the inner core into the passageway at the outer surface 526 of the second end flange 514. Pressure is applied to the second end surface 562 of the inner core to force the inner core into the passageway. As the first end surface 560 of the inner core 550 is pressed into the passageway, the inner core 550 initially rides upon the shorter (vertically) portions of the upper and lower passageway ribs 600 and then begins to crush the nylon ribs as the first end surface of the inner core is pressed further toward the outer surface 522 of the first end flange 512 of the bobbin 510 and encounters the portions of the passageway ribs of increasingly greater height. In certain embodiments, the inner core 550 is positioned such that the end surfaces of the inner core are positioned by approximately the same distance from the respective outer surfaces of the end flanges (e.g., either flush with the respective outer surfaces or recessed by approximately the same distance from the respective outer surfaces). After the inner core is positioned and the pressure is removed from the second end the resilience of the crushable nylon presses against the top and bottom surfaces of the inner core to securely retain the inner core in a fixed longitudinal position within the passageway. As a result, the inner core is substantially centered in the passageway between the upper and lower passageway ribs as shown in the front elevational view of FIG. 19.

As further illustrated in FIGS. 14-19, the bobbin 510 of the magnetic assembly 500 further includes a plurality of outer positioning ribs 610 on the outer surface 522 of the first end flange 512 and on the outer surface 526 of the second end flange 514. In the illustrated embodiment, each outer surface includes two outer positioning ribs 610 for a total of four positioning ribs. One outer positioning rib is positioned on either side of the opening to the passageway 530 on each outer surface. Each outer positioning rib 610 extends from a respective base end 512 at an intersection of the respective outer surface with the respective base platform 542, 544 and extends to a respective terminal end 514 near the top of the respective outer surface. Each outer positioning rib 610 tapers to an increasingly smaller size from the respective base end to the respective terminal end. In the illustrated embodiment, the taper is generally continuous from the base end to the terminal end of the rib. In alternative embodiments, an initial portion of the rib proximate to the base end can be untapered with a portion of the rib proximate to the terminal end being tapered.

The outer positioning ribs 610 of FIGS. 14-19 have dimensions similar to the dimensions of the outer positioning ribs 410 of FIGS. 7-12 except the vertical lengths of the ribs 610 are shorter than the ribs 410 because the first and second end flanges are shorter to accommodate the lower profile of the passageway of the embodiment of FIGS. 7-12.

The four outer positioning ribs 610 position and secure the rectangular outer core 552 with respect to the bobbin 510 in accordance with the assembly method described above with respect to the embodiment of FIGS. 7-12. Accordingly, the gaps 594, 596 are substantially equal as shown. As with the embodiment of FIGS. 7-12, no gluing, taping or other additional steps are required to complete the assembly process for the embodiment of FIGS. 14-19.

Figure 20:
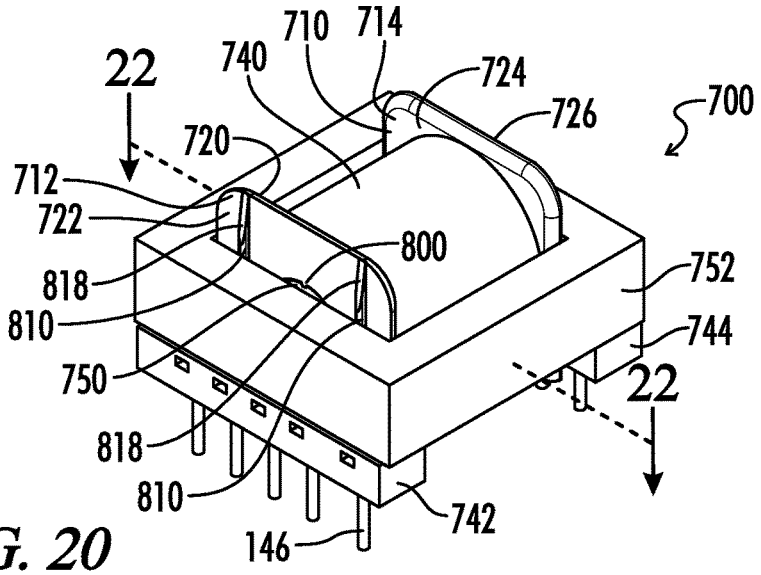
FIG. 20 illustrates a perspective view of a magnetic assembly 700 having an inner core with a circular cross section in accordance with improvements disclosed herein.
Figure 21:
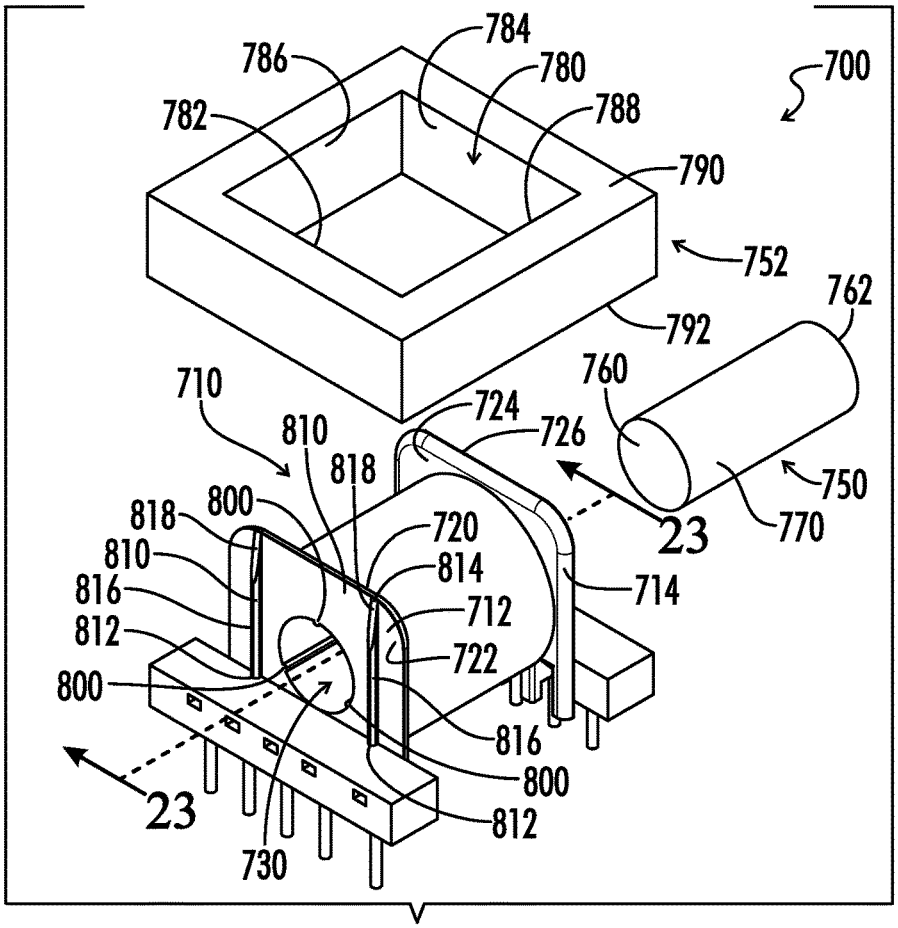
FIG. 21 illustrates an exploded perspective view of the magnetic assembly of FIG. 20.
Figure 22:
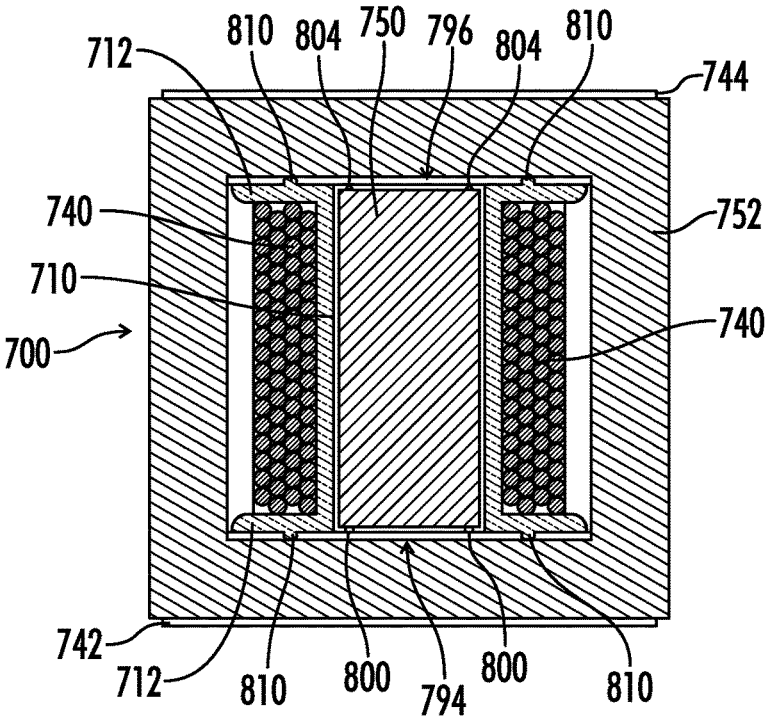
FIG. 22 illustrates a cross-sectional upper plan view of the assembly of FIG. 20 taken along line 22-22 in FIG. 20.
Figure 23:
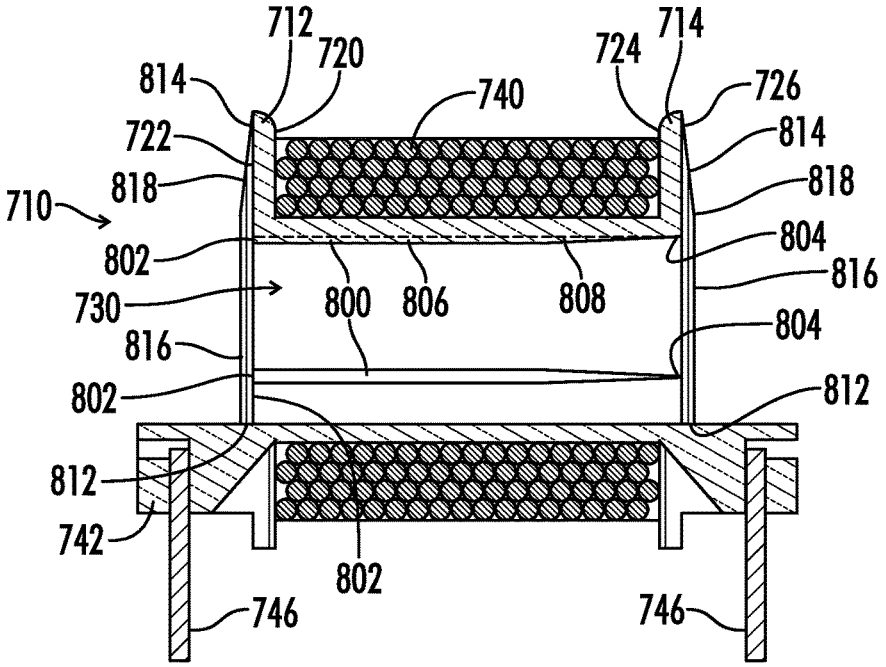
FIG. 23 illustrates a cross-sectional elevational view of the bobbin in FIG. 21 taken along line 23-23 in FIG. 21.
Figure 24:
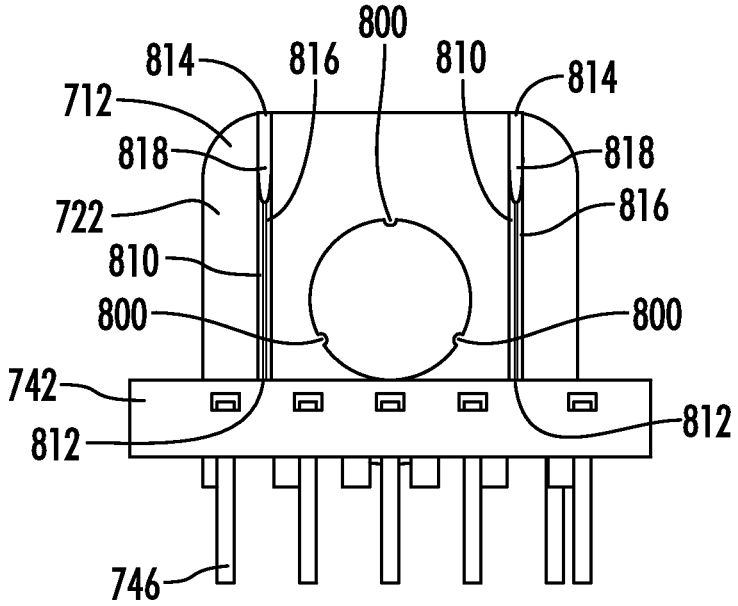
FIG. 24 illustrates the front elevational view of the bobbin of FIG. 21 before inserting the center core.
Figure 25:
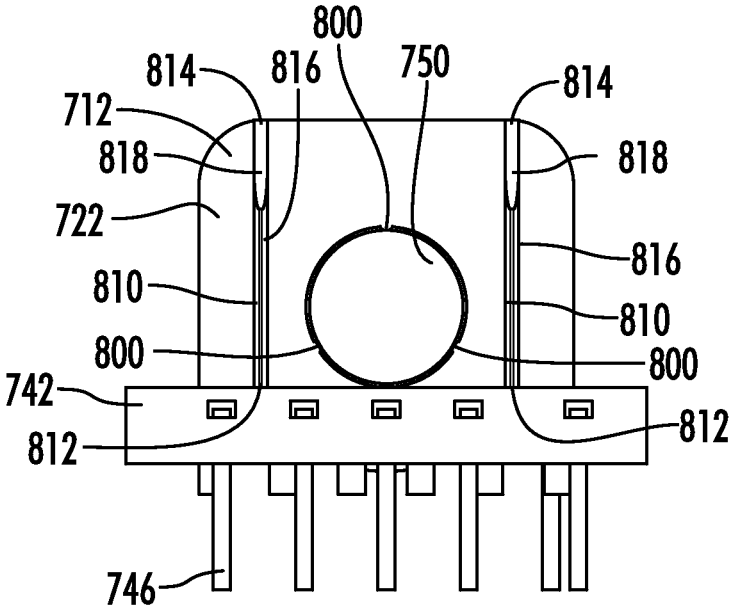
FIG. 25 illustrates the front elevational view of the bobbin of FIG. 21 after inserting the center core.

FIG. 20 illustrates a perspective view of a magnetic assembly 700 having an inner core with a circular cross section in accordance with improvements disclosed herein. FIG. 21 illustrates an exploded perspective view of the magnetic assembly of FIG. 20. FIG. 22 illustrates a cross-sectional upper plan view of the assembly of FIG. 20 taken along the lines 22-22 in FIG. 20. FIG. 23 illustrates a cross-sectional elevational view of the bobbin taken along the lines 23-23 in FIG. 20. FIG. 24 illustrates a front elevational view of the front of the bobbin of FIG. 21 before inserting the central core. FIG. 25 illustrates the front elevational view of FIG. 24 after inserting the central core.

The magnetic assembly 700 of FIGS. 20-25 includes a bobbin 710 having a first end flange 712 and a second end flange 714. In the illustrated embodiment, the bobbin 710 may be formed of nylon as described above with respect to the bobbin 310. The first end flange has an inner surface 720 and an outer surface 722. The second end flange has an inner surface 724 and an outer surface 726. A longitudinal passageway 730 extends from the outer surface of the first end flange to the outer surface of the second end flange. The passageway 730 has a cross-sectional profile. In the illustrated assembly, the profile is generally circular such the entire profile is arcuate. The circular (arcuate) passageway of the embodiment of FIGS. 22-25 provides an advantage over the conventional rectangular passageway by reducing the length of wire required for each turn of the winding.

The bobbin 710 further includes a winding 740 similar to the winding 740 described above except that the turns of the windings are circular. Only the protective outer covering of the winding is shown in FIGS. 20 and 21. The first end flange 712 is supported by a first base platform 742. The second end flange 714 is supported by a second base platform 744. The base platforms include a plurality of contact pins 746 that are useable to mount the magnetic assembly to a circuit board (not shown). Some or all of the contact pins 746 are electrically connected to the winding to provide electrical communication from the winding to a circuit board.

As illustrated in FIGS. 20-25, the magnetic assembly 700 has an inner core 750 and an outer core 752 similar to the inner core 350 and the outer core 352 of FIGS. 7-12 except that the inner core 750 is entirely circular to conform to the profile of the passageway 730 through the bobbin 710.

The inner core 750 has a longitudinal length between a first end surface 760 and a second end surface 762 that is less than or equal to the longitudinal length of the passageway 730. When the inner core 750 is centered within the passageway, the first end surface 760 is proximate to the first end flange 712, and the second end surface 762 is proximate to the second end flange 714. In embodiments where the longitudinal length of the inner core 750 is the same as the longitudinal length of the passageway 730, the first and second end surfaces of the inner core 750 may be flush with the outer surface 722 of the first end flange 712 and the outer surface 726 of the second end flange. In other embodiments where the longitudinal length of the inner core 750 is less than the longitudinal length of the passageway 730, the first and second end surfaces may be recessed by a small amount from the respective outer surfaces of the flanges. For example, in the illustrated embodiment, the longitudinal length of the inner core is approximately 0.01 inch shorter than the longitudinal length of the passageway, and each end surface of the inner core is recessed by approximately 0.005 inch from the respective outer surface of the respective end flange.

The inner core 750 is cylindrical and has a circular profile defined by a cylindrical outer surface 770. The profile of the inner core is selected to conform to the profile of the passageway 730. The diameter of the inner core 750 is selected to be slightly smaller than the diameter of the passageway so that the inner core fits barely within the passageway when inserted from the outer surface of the second end flange.

In the illustrated embodiment, the outer core 752 is a rectangular parallelepiped with a hollow inner cavity 780 sized to receive the bobbin 710. The outer core 752 may have a continuous wall of a ferromagnetic material (e.g., a sintered ferrite core of iron, manganese and zinc) that surrounds the hollow inner cavity 780. The hollow inner cavity 780 of the outer core is defined by a first inner surface 782 and a parallel second inner surface 784. The first and second inner surfaces are perpendicular to a third inner surface 786 and to a fourth inner surface 788. The third and fourth inner surfaces are spaced apart by a distance selected to be substantially equal to a width of each of the first end flange 712 and the second end flange 714 so that the outer core is positionable on the bobbin 710 with the third and fourth inner surfaces abutted against the end flanges as shown in FIG. 20. The outer core 752 further has an upper surface 790 and a lower surface 792.

The first inner surface 780 and the second inner surface 782 of the outer core 752 are spaced apart by a distance greater than the longitudinal length of the passageway 730. When the outer core is positioned on the bobbin 710 as shown in FIG. 20 and is centered with respect to the longitudinal length of the passageway, the first inner surface of the outer core 752 is spaced apart from the first end surface 760 of the inner core 750 by a first distance to form a first gap 794, and the second inner surface of the outer core 752 is spaced apart from the second end surface 762 of the inner core by a second distance to form a second gap 796. Preferably, the first distance and the second distance are substantially equal. The two gaps provide benefits described above in connection with the embodiment of FIGS. 7-12.

In the illustrated embodiment, the cross-sectional profile of the rectangular outer core 752 has a height between the upper surface 790 and the lower surface 792 similar to the height of the rectangular outer core 352 of the embodiment of FIGS. 7-12. The inner core 750 has a diameter that is approximately equal to the height of the rectangular outer core 752. As illustrated the height of the rectangular outer core 952 is less than the height of the first end flange 712 and the second end flange 714. Thus, the tops of the end flanges extend a substantial distance above the upper surface 790 of the outer core such that the overall height of the magnetic assembly 700 is substantially greater than the height of the rectangular outer core. Accordingly, the magnetic assembly may be considered to be a "tall" magnetic assembly.

As further illustrated in FIGS. 20-25, the passageway 730 of the bobbin 710 includes a plurality of passageway ribs 800. In the illustrated embodiment, three passageway ribs 800 are provided with a first rib positioned near the topmost surface of the passageway 730, with a second rib positioned approximately 120 degrees clockwise from the first (top) rib, and with a third rib positioned approximately 240 degrees clockwise from the first rib, such that the ribs are equally spaced around the inner circumference of the passageway. A different number of ribs can be incorporated into the inner surface of the passageway, and the ribs can be spaced apart by different angular amounts. The ribs in FIGS. 20-25 can be similar to the ribs described above with respect to the magnetic assembly 300 and the magnetic assembly 500; however, FIGS. 20-25 disclose ribs that have a different structure. The ribs of FIGS. 20-25 can be substituted for the previously described ribs in the embodiments of FIGS. 7-12 and FIGS. 14-19.

As shown in the elevational front view of FIG. 24, each passageway rib 800 is configured as a generally semicircular protuberance with the base of the protuberance intersecting the inner surface of the passageway and with the circular perimeter extending into the passageway. As shown in the elevational cross-sectional view of FIG. 23 and the cross-sectional plan view of FIG. 22, each passageway rib 800 tapers from a first thickness and a first width at a first end 802 proximate to the first end flange 712 to a relatively small second thickness and a relatively small second width at a second end 804 near the second end flange 714. The passageway ribs 800 of this embodiment can have similar widths, heights and lengths to the corresponding widths, heights and lengths of the passageway ribs 400 of the embodiment of FIGS. 7-12 and the passageway ribs 600 of FIGS. 14-19. Each passageway rib 800 can taper continuously from the first end of the rib the second end of the rib as shown and described with respect to the previously described passageway ribs; however, in the illustrated embodiment of FIGS. 20-25, each passageway rib 800 has an initial portion 806 proximate to the first end of the rib and has a second tapered portion 808 proximate to the second end of the rib. The initial portion 806 is untapered, and the second portion 808 is tapered. For example, the untapered initial portion may be about ⅔ of the length of the rib and the tapered second portion may be approximately ⅓ of the length of the rib.

The inner core 750 is positioned in the passageway 730 by inserting the first end surface 760 of the inner core into the passageway at the outer surface 726 of the second end flange 714. A force is applied to the second end surface 762 of the inner core to force the inner core into the passageway. As the first end surface 760 of the inner core 750 is pressed into the passageway, the inner core 750 initially rides upon the shorter (vertically) portions of the upper and lower passageway ribs 800 and then begins to crush the ribs as the first end surface of the inner core is pressed further toward the outer surface 722 of the first end flange 712 of the bobbin 710 and encounters the portions of the passageway ribs of increasingly greater height. In certain embodiments, the inner core 750 is positioned such that the end surfaces of the inner core are positioned by approximately the same distance from the respective outer surfaces of the end flanges (e.g., either flush with the respective outer surfaces or recessed by approximately the same distance from the respective outer surfaces). After the inner core 750 is positioned in the passageway and the force is removed from the second end, the resilience of the crushable nylon rib presses against the top and bottom surfaces of the inner core to securely retain the inner core in a fixed longitudinal position within the passageway.

As further illustrated in FIGS. 20-25, the bobbin 710 of the magnetic assembly 700 further includes a plurality of outer positioning ribs 810 on the outer surface 722 of the first end flange 712 and on the outer surface 726 of the second end flange 714. In the illustrated embodiment, each outer surface includes two outer positioning ribs for a total of four positioning ribs. One outer positioning rib is positioned on either side of the opening to the passageway 730 on each outer surface. Each outer positioning rib extends from a respective base end 812 at an intersection of the respective outer surface with the respective base platform 742, 744 and extends to a respective terminal end 814 near the top of the respective outer surface. Each outer positioning rib tapers to an increasingly smaller size from the respective base end to the respective terminal end.

The outer positioning ribs 810 of FIGS. 20-25 have dimensions similar to the dimensions of the outer positioning ribs 410 of FIGS. 7-12. Each outer positioning rib 810 can taper continuously from the first (base) end of the rib to the second (terminal) end of the rib as shown and described with respect to the previously described passageway ribs; however, in the illustrated embodiment of FIGS. 20-25, each outer positioning rib 810 has an initial portion 816 proximate to the first end of the rib and has a second portion 818 proximate to the terminal end of the rib. The initial portion is untapered, and the second portion is tapered. For example, the untapered initial portion may comprise about ⅔ of the length of the rib and the tapered second portion may comprise approximately ⅓ of the length of the rib.

The four outer positioning ribs 810 position and secure the rectangular outer core 752 with respect to the bobbin 710 in accordance with the assembly method described above with respect to the embodiment of FIGS. 7-12. Accordingly, the gaps 794, 796 are substantially equal as shown. As with the embodiment of FIGS. 7-12, no gluing, taping or other additional steps are required to complete the assembly process for the embodiment of FIGS. 20-25.

Figure 26:
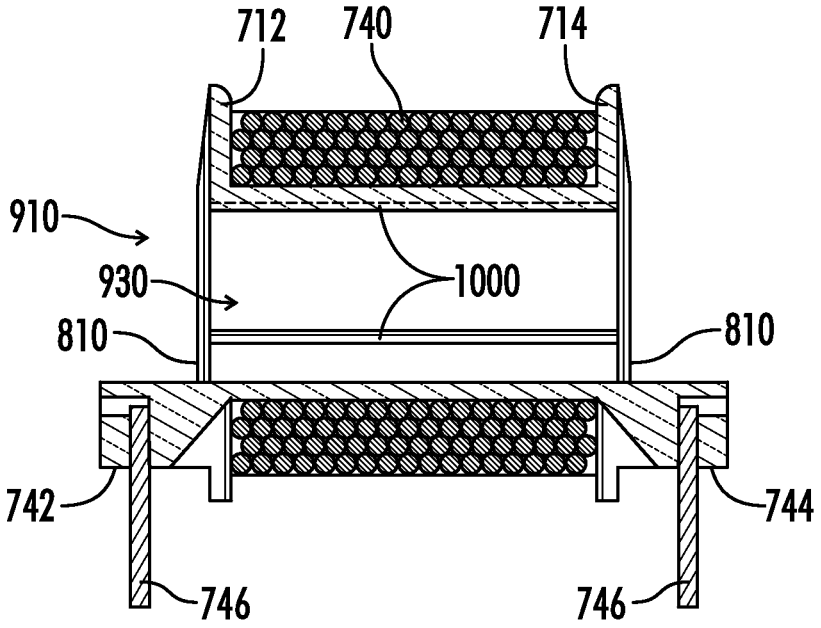
FIG. 26 illustrates a cross-sectional elevational view similar to FIG. 23 for an alternative embodiment wherein the passageway ribs are untapered.

FIG. 26 illustrates a cross-sectional elevational view similar to FIG. 23 for an alternative embodiment of a bobbin 910 for the magnetic assembly 700 wherein the passageway ribs are untapered. The bobbin 910 of FIG. 23 is similar to the bobbin 710 of FIGS. 20-25, and the corresponding elements are numbered accordingly. The bobbin 910 differs from the previously described bobbin 710 by having a passageway 930 with a different configuration for a plurality of passageway ribs 1000. The passageway ribs of FIG. 26 are positioned as before (e.g., 120 degrees apart around the circumference of the passageway. Unlike the previously described passageway ribs, which are at least partially tapered, the passageway ribs are untapered and extend from the first end flange 712 to the second end flange 714 with a substantially constant (e.g., generally semicircular profile). In the embodiment of FIG. 26, the inner core 750 (FIG. 21) is press fit into the passageway in frictional engagement with the passageway ribs such the inner core is retained securely within the passageway as described above.

Although there have been described particular embodiments of the present invention of a new and useful "Magnetic Core Structures for Magnetic Assemblies," it is not intended that such references be construed as limitations upon the scope of this invention except as set forth in the following claims.

What is claimed is:

1. A magnetic assembly comprising:

a bobbin comprising a first outer flange and a second outer flange, a passageway extending through the bobbin from the first outer flange to the second outer flange, and at least one winding wound about the passageway, the bobbin further comprising at least one crushable passageway rib protruding into the passageway and at least one crushable flange rib on each outer flange; and a magnetic core comprising an inner core positioned through the passageway of the bobbin, the inner core having a first end surface proximate to the first outer flange and having a second end surface proximate the second outer flange, the inner core positioned in frictional engagement with the crushable passageway rib, and an outer core having a first inner surface and a second inner surface, the outer core positioned around the bobbin with the first inner surface in frictional engagement with the at least one crushable flange rib on the first outer flange, the first inner surface spaced apart from the first end surface of the inner core by a first gap distance, and with the second inner surface in frictional engagement with the at least one crushable flange rib on the second outer flange, the second inner surface spaced apart from the second end surface of the inner core by a second gap distance.

2. The magnetic assembly as defined in claim 1, wherein the first gap distance is substantially equal to the second gap distance.

3. The magnetic assembly as defined in claim 1, wherein the at least one passageway rib includes a first passageway rib on a first inner surface of the passageway and a second passageway rib on a second inner surface of the passageway, the second passageway rib positioned across from the first passageway rib.

4. The magnetic assembly as defined in claim 1, wherein the at least one passageway rib is tapered from a first protrusion height proximate to the first outer flange to a smaller second protrusion height in a direction toward the second outer flange.

5. The magnetic assembly as defined in claim 4, wherein the inner core extends into the passageway from the second outer flange to the first outer flange, the inner core crushing the at least one passageway rib into frictional engagement with the inner core.

6. The magnetic assembly as defined in claim 1, wherein the at least one flange rib on each of the first and second outer flanges comprises a first flange rib on a first side of the passageway and a second flange rib on a second side of the passageway.

7. The magnetic assembly as defined in claim 1, wherein each flange rib is tapered from a first thickness at one end of the flange rib to a second smaller thickness at a second end of the flange rib.

8. The magnetic assembly as defined in claim 7, wherein the outer core has a lower surface, and wherein the outer core is positioned over the flange ribs with the lower surface of the outer core proximate to the second ends of the flange ribs, the inner surfaces of the outer core crushing and frictionally engaging the flange ribs to secure the outer core to the bobbin.

9. The magnetic assembly as defined in claim 1, wherein the outer core is rectangular.

10. The magnetic assembly as defined in claim 1, wherein the passageway has a profile selected to have at least two arcuate sides, and wherein the inner core has a profile selected such that the inner core fits snugly within the passageway.

11. The magnetic assembly as defined in claim 10, wherein the passageway profile and the inner core profile are oval with the two arcuate sides at opposing ends of the oval and with first and second straight sides connecting the two arcuate sides.

12. The magnetic assembly as defined in claim 11, wherein the first and second straight sides are vertical.

13. The magnetic assembly as defined in claim 11, wherein the first and second straight sides are horizontal, and the magnetic assembly is a low profile magnetic assembly.

14. A magnetic assembly comprising:

a bobbin comprising a first end flange with a first outer flange surface, a second end flange with a second outer flange surface, a passageway extending from the first end flange to the second end flange, the passageway having a passageway length, and at least one winding wound about the passageway between the first end flange and the second end flange;

an inner core positioned in the passageway, the inner core having a first end surface and second end surface and having an inner core length between the first end surface and the second end surface, the inner core length being substantially equal to the passageway length, the inner core positioned in the passageway with the first end surface proximate to the first end flange and with the second end surface proximate to the second end flange; and an outer core positioned around the bobbin, the outer core having a first inner surface and a second inner surface, the second inner surface parallel to the first inner surface, the first inner surface and the second surface spaced apart by an outer core inner surface spacing selected to be greater than the inner core length, the outer core positioned with respect to the inner core such that the first inner surface of the outer core is spaced apart from the first end surface of the inner core by a first gap distance and the second inner surface of the outer core is spaced apart from the second end surface of the inner core by a second gap distance, wherein:

the first outer flange surface of the first end flange and the second outer flange surface of the second end flange each comprise a respective first flange rib on a first side of the passageway and a respective second flange rib on a second side of the passageway, each flange rib comprising a crushable material, each flange rib tapered from a first thickness at a first end of the flange rib to a second smaller thickness at a second end of the flange rib; and the outer core is positioned on the flange ribs with the first inner surface of the outer core proximate to the first and second flange ribs of the first end flange and with the second inner surface of the outer core proximate the first and second flange ribs of the second end flange, the first and second inner surfaces of the outer core crushing the flange ribs to cause the flange ribs to apply friction to the first and second inner surfaces of the outer core to secure the outer core onto the bobbin, the first and second flange ribs of the first end flange spacing the first inner surface of the outer core apart from the first end surface of the inner core by the first gap distance, the first and second flange ribs of the second end flange spacing the second inner surface of the outer core apart from the second end surface of the inner core by the second gap distance.

15. The magnetic assembly as defined in claim 14, wherein the first gap distance and the second gap distance are substantially equal.

16. The magnetic assembly as defined in claim 14, wherein the passageway comprises at least one passageway rib, the at least one passageway rib comprising a crushable material and being tapered to protrude into the passageway by a first protrusion distance proximate the first end flange and to protrude into the passageway by a second protrusion distance at a position closer to the second end flange, the at least one passageway rib crushed by the insertion of the inner core into the passageway to cause the at least one passageway rib to frictionally engage the inner core and secure the inner core in the passageway.

17. The magnetic assembly as defined in claim 14, wherein the outer core is rectangular.

* * * * *